US012018447B2

(12) United States Patent
Daniel et al.

(10) Patent No.: US 12,018,447 B2
(45) Date of Patent: Jun. 25, 2024

(54) FLOOD PROTECTION AND FLUID DIVERSION SYSTEM

(71) Applicant: Portadam, Inc., Williamstown, NJ (US)

(72) Inventors: Jyothish Daniel, Williamstown, NJ (US); Kristin Alzheimer, Williamstown, NJ (US)

(73) Assignee: WATER DIVERSION, LLC, Williamstown, NJ (US)

( * ) Notice: Subject to any disclaimer, the term of this patent is extended or adjusted under 35 U.S.C. 154(b) by 0 days.

(21) Appl. No.: 17/933,315

(22) Filed: Sep. 19, 2022

(65) Prior Publication Data

US 2023/0407587 A1 Dec. 21, 2023

Related U.S. Application Data

(60) Provisional application No. 63/366,672, filed on Jun. 20, 2022.

(51) Int. Cl.
*E02B 3/10* (2006.01)

(52) U.S. Cl.
CPC ..... *E02B 3/106* (2013.01)

(58) Field of Classification Search
CPC ..... E02B 3/106; E02B 7/20; E02D 19/02; E02D 19/04; B65D 90/047
See application file for complete search history.

(56) References Cited

U.S. PATENT DOCUMENTS 4,136,995 A 1/1979 Fish
4,511,286 A 4/1985 Hardacre
5,924,666 A * 7/1999 Liu ..... A47B 21/0314 248/278.1
6,021,985 A 2/2000 Hahn
(Continued)

FOREIGN PATENT DOCUMENTS

DE 102017004594 A1 11/2018
EP 2257675 A1 12/2010
(Continued)

OTHER PUBLICATIONS

International Search Report and Written Opinion dated Jun. 7, 2023, PCT/US2023/60801, 13 pages, dated Jun. 7, 2023.
(Continued)

*Primary Examiner* — Benjamin F Fiorello
(74) *Attorney, Agent, or Firm* — Heslin Rothenberg Farley & Mesiti P.C.; Victor A. Cardona, Esq.

(57) ABSTRACT

A structure for use with a liner such as for use in a rapid deployment flood protection system for diverting a liquid. The structure may include frames connected by horizontal link bars. The frames may include a dam face, a base, and a brace, and may include a collapsed configuration with the braces and the bases aligned with the dam faces, and a configuration with the dam faces inclined at an acute angle relative to the bases and the braces extending between the bases and dam faces. The frames may include the base having a bump stop and a quick release pin for connecting the brace to the base. The frames may include a C-shaped brace and a sleeve extending between legs of the lower end of the C-shaped brace, and a quick release pin extendable through the C-shaped base and the sleeve.

29 Claims, 35 Drawing Sheets

(56) References Cited

U.S. PATENT DOCUMENTS

| | | | | |
|---|---|---|---|---|
| 6,079,904 | A | 6/2000 | Trisi | |
| 6,238,137 | B1 | 5/2001 | Whitworth et al. | |
| 6,840,711 | B1 | 1/2005 | Martinez et al. | |
| 6,983,569 | B1 * | 1/2006 | Rosenberg | E04B 2/767 52/241 |
| 8,434,967 | B2 | 5/2013 | Nero | |
| 8,662,335 | B2 | 3/2014 | Van Romer | |
| 8,960,632 | B2 * | 2/2015 | Fallows | F16M 11/2092 248/575 |
| 9,120,619 | B2 | 9/2015 | Hoopes et al. | |
| 9,157,205 | B1 | 10/2015 | Novotny et al. | |
| 10,458,084 | B2 | 10/2019 | Nero | |
| 10,508,396 | B2 * | 12/2019 | Kullberg | E02B 3/106 |
| 11,168,452 | B2 * | 11/2021 | Ward | E02B 3/106 |
| 2003/0156903 | A1 | 8/2003 | Wiseman et al. | |
| 2004/0265063 | A1 | 12/2004 | Kullberg | |
| 2010/0126106 | A1 | 5/2010 | Ivarsson | |
| 2012/0230768 | A1 | 9/2012 | Rowland et al. | |
| 2012/0261414 | A1 | 10/2012 | Mann et al. | |
| 2018/0274190 | A1 | 9/2018 | Nero | |
| 2018/0298575 | A1 | 10/2018 | Kullberg | |

FOREIGN PATENT DOCUMENTS

| | | | |
|---|---|---|---|
| EP | 3356606 | A1 | 8/2018 |
| WO | 2009103429 | A1 | 8/2009 |
| WO | 2015048934 | A1 | 4/2015 |
| WO | 2017055079 | A1 | 4/2017 |

OTHER PUBLICATIONS

Daniel et al., U.S. Appl. No. 17/484,052, entitled "Flood Control System," filed Sep. 24, 2021.

Canadian Examiner's Requisition dated Apr. 18, 2024, from related Canadian Patent Application No. 3, 175, 745, 5 pages.

* cited by examiner

*FIG. 5*
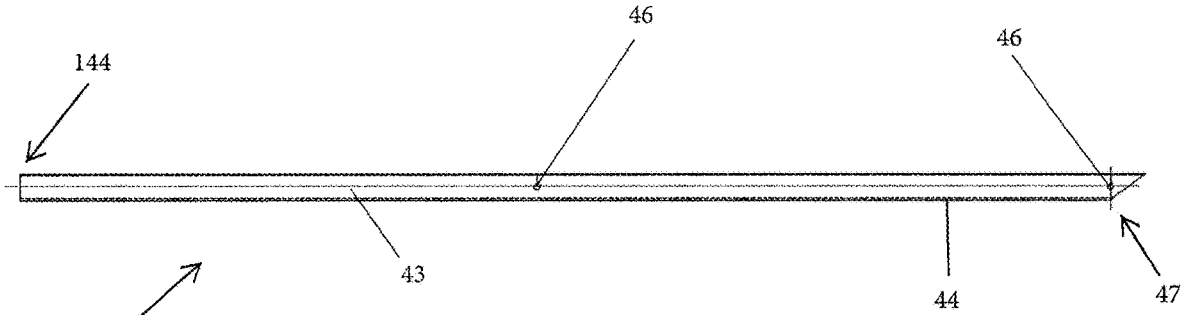
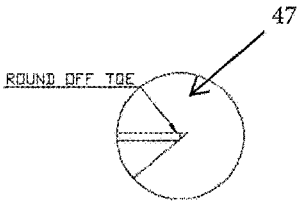
*FIG. 6*
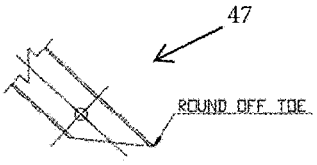
*FIG. 7*

FLOOD PROTECTION AND FLUID DIVERSION SYSTEM

CROSS REFERENCE TO RELATED APPLICATIONS

This application claims priority from U.S. Provisional Patent Application No. 63/366,672, filed Jun. 20, 2022, entitled "Flood Protection And Fluid Diversion System", the entire disclosure of which is incorporated herein by reference.

This application is a related to U.S. patent application Ser. No. 17/484,052, filed Sep. 24, 2021, entitled "Flood Control System", the entire disclosure of which is incorporated herein by reference.

TECHNICAL FIELD

The present disclosure relates to configurable and deployable modular flood control systems and methods.

BACKGROUND

Flood control and water diversion may be necessary in a variety of situations. Natural disasters including hurricanes and other storms may require water to be diverted from particular locations to avoid flooding and the resulting property and human costs. Water diversion may also be necessary to allow construction or maintenance in a particular location, such as a hydroelectric or water storage dam.

Thus, a need exists for systems and methods for diverting liquids above ground to allow maintenance, avoid human and property damage, and facilitate commercial processes.

SUMMARY

The shortcomings of the prior art are overcome and additional advantages are provided through the provision, in one embodiment, a support structure for use with a liner such as for use in a deployment flood protection system for diverting a liquid. The support structure may include a plurality of spaced-apart frames, each of the plurality of spaced-apart frames having a dam face having an upper end and a lower end, a base having a first end and second end, the first end of the base includes a bump stop, the second end pivotally connected to the lower end of the dam face, and a brace having an upper end and a lower end, the upper end of the brace pivotally connected to the dam face. The frame includes a collapsed configuration with the brace and the base aligned with the dam face, and an expanded configuration where the brace extends between the base and dam face with the lower end of the brace is engageable with the bump stop so that the dam face is inclined at an acute angle relative to the base. A plurality of horizontally spaced-apart link bars operably connect and extend between the dam faces of the plurality of spaced-apart frames. The bases of the plurality of spaced-apart frames are configured to be located on a ground surface to support the support structure, and the support structure operable for supporting the liner and a liquid when a liquid is received in a portion bounded by the liner.

In some embodiments, the support structure includes a removable connector, such as a quick release pin for connecting the lower end of the brace to the first end of the base when disposed in the expanded configuration. In some embodiments, the brace includes a C-shaped brace and a sleeve extending between legs of the lower end of the C-shaped brace, and a removable connector extendable through the base and the sleeve. In some embodiments, a connector is provided for pivotably connecting the upper end of the brace to the dam face, a first spacer disposed around the connector and disposed between the brace and the dam face, and a second spacer disposed around the connector and disposed between the brace and the dam face. The connector may include a pin welded to and extending between legs of the C-shaped dam face.

In some embodiments, each of the plurality of spaced-apart frames may include a second brace having an upper end and a lower end, the upper end of the brace operably connected to the dam face, and the lower end of the brace operably connected to the base. A quick release pin may operably connect the upper end of the brace to the dam base, and a quick release pin may operably connect the lower end of the brace to the base.

In some embodiments, a support structure for use with a liner in a deployment flood protection and fluid diversion system may include a plurality of spaced-apart frames, each of the plurality of spaced-apart frames having a dam face having an upper end and a lower end, a base having a first end and second end, the second end pivotally connected to the lower end of the dam face, a C-shaped brace includes an upper end pivotally connected to the dam face, and a lower end of the brace having a sleeve extending between legs of the lower end of the C-shaped brace. A removable connector is extendable through the base and the sleeve. A fixed connector pivotably connects the upper end of the brace to the dam face, a first spacer is disposed around the connector and disposed between the brace and the dam face, and a second spacer disposed around the connector and disposed between the brace and the dam face. The frame includes a first collapsed configuration with the brace and the base aligned with the dam face, and a second configuration where the brace extends between the base and dam face so that the dam face is inclined at an acute angle relative to the base. A plurality of horizontally spaced-apart link bars operably connect and extend between the dam faces of the plurality of spaced-apart frames. The bases of the plurality of spaced-apart frames are configured to be located on a ground surface to support the support structure, and the support structure is operable for supporting the liner and a liquid when a liquid is received in a portion bounded by the liner. In some embodiments, the sleeve extends outwardly from the legs of the C-shaped brace and/or the removable connector includes a quick release pin.

In some embodiments, a method is provided for use in diverting a liquid, which includes providing the about noted support structures in the collapsed configuration, positioning the support structure in the expanded configuration, locking the support structure in the expended configuration with a quick-release pin, and locating the liner against the dam faces of the support structure.

In some embodiment, a method includes obtaining a first frame having a collapsed configuration, the first frame includes a first dam face, a first brace, and a first base, moving a lower end of the first brace to engage a bump stop on the first base so that the first frame is disposed in an expanded configuration with the first dam face inclined at an acute angle relative to the first base, installing a first connector to lock the lower end of the first brace to the first base and lock the first frame in the expanded configuration, obtaining a second frame having a collapsed configuration, the second frame includes a second dam face, a second brace, and a second base, moving a lower end of the second brace to engage a bump stop on the second base so that the second frame is disposed in an expanded configuration with the second dam face inclined at an acute angle relative to the second base, installing a second connector to lock the lower end of the first brace to the first base and lock the second frame in the expanded configuration, connecting the first frame to the second frame with a plurality of link bars extending between the first dam face and the second dam face for form a support structure, and wherein the first and second bases are locatable on a ground surface to support the support structure operable for supporting the liner and a liquid when a liquid is received in a portion bounded by the liner.

BRIEF DESCRIPTION OF THE DRAWINGS

The subject matter, which is regarded as the disclosure, is particularly pointed out and distinctly claimed in the claims at the conclusion of the specification. The foregoing and other objects, features, and advantages of the disclosure will be readily understood from the following detailed description of aspects of the disclosure taken in conjunction with the accompanying drawings in which:

FIG. 5 is a side view of the dam face of FIG. 4, according to an embodiment of the present disclosure;

FIG. 6 is a blow-up of a side view of a round off toe of the dam face of FIG. 4, according to an embodiment of the present disclosure;

FIG. 7 is a side view of a blow-up of a toe of the dam face of FIG. 5, according to an embodiment of the present disclosure;

DETAILED DESCRIPTION

Figure 1:
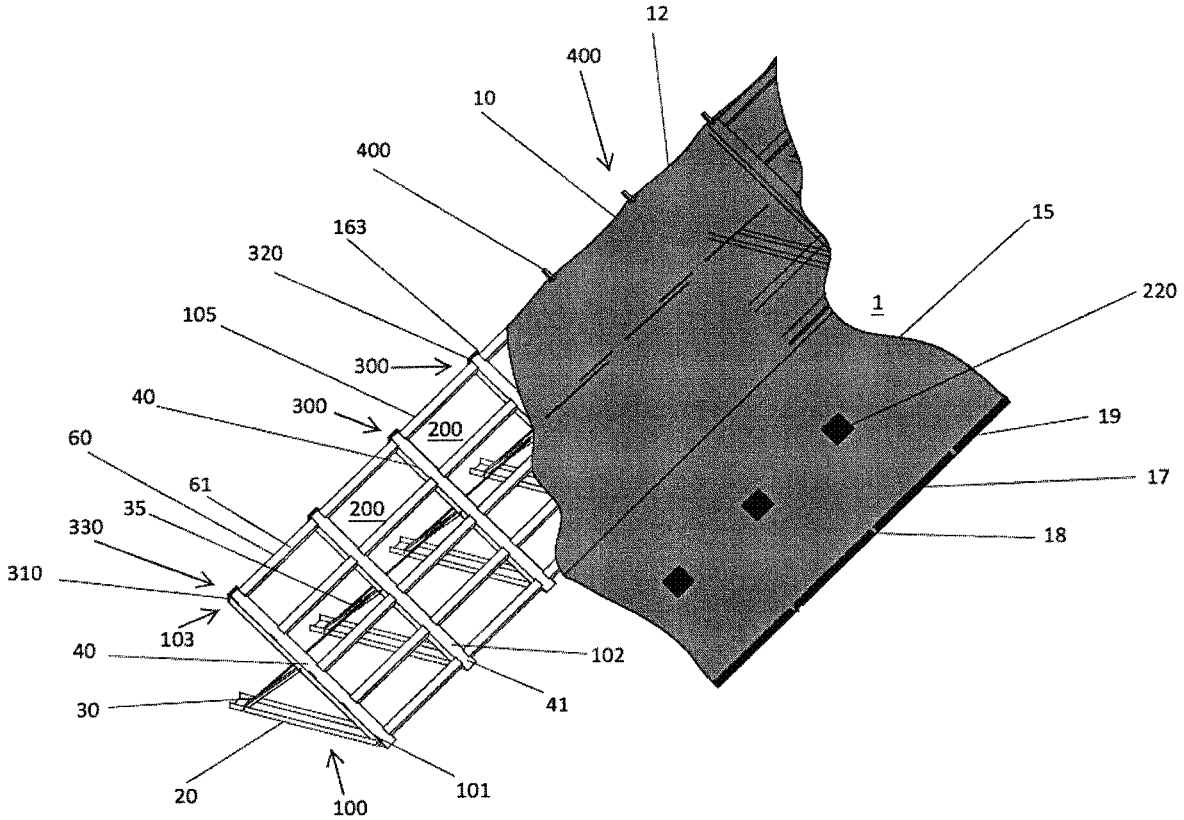
FIG. 1 is a perspective view of a system for diverting a liquid including frame supporting units supporting a liner, according to an embodiment of the present disclosure.

The present disclosure will be discussed hereinafter in detail in terms of various exemplary embodiments according to the present disclosure with reference to the accompanying drawings. In the following detailed description, numerous specific details are set forth in order to provide a thorough understanding of the present disclosure. It will be obvious, however, to those skilled in the art that the present disclosure may be practiced without these specific details. In other instances, well-known structures are not shown in detail in order to avoid unnecessary obscuring of the present disclosure.

Thus, all the implementations described below are exemplary implementations provided to enable persons skilled in the art to make or use the embodiments of the disclosure and are not intended to limit the scope of the disclosure, which is defined by the claims. As used herein, the word "exemplary" or "illustrative" means "serving as an example, instance, or illustration." Any implementation described herein as "exemplary" or "illustrative" is not necessarily to be construed as preferred or advantageous over other implementations. Moreover, in the present description, the terms "upper", "lower", "left", "rear", "right", "front", "vertical", "horizontal", and derivatives thereof shall relate to the disclosure as oriented in FIG. 1.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In accordance with the principals of the present disclosure, systems and methods for diverting liquids are provided. In an exemplary embodiment depicted in FIGS. 1-22, a flood protection or diversion system 5 is shown. Flood protection/diversion system 5 could be any type of water diversion barrier system, such as a water diversion structure, dam, flood control structure, or other structure for inhibiting or preventing movement of water through the barrier system toward an undesired area or areas.

Diversion system 5 may be configured (e.g., shaped and dimensioned) to any shape and to various heights. Diversion system 5 may include a series of interconnected supporting structures or frame units 100 spaced at intervals erected on a prepared surface (e.g., a concrete pad) or an irregular surface (e.g., a ground surface) to form a container skeleton or support structure for supporting a liner 10. Each frame unit, such as a frame 101 of frame units 100 depicted in FIGS. 1-3, includes a brace 30 and a dam face 40 facing a wet side portion 50 of the barrier system which may hold liquid such as water to inhibit movement thereof in an undesired direction. A base 20 may connect brace 30 and dam face 40.

Figure 2:
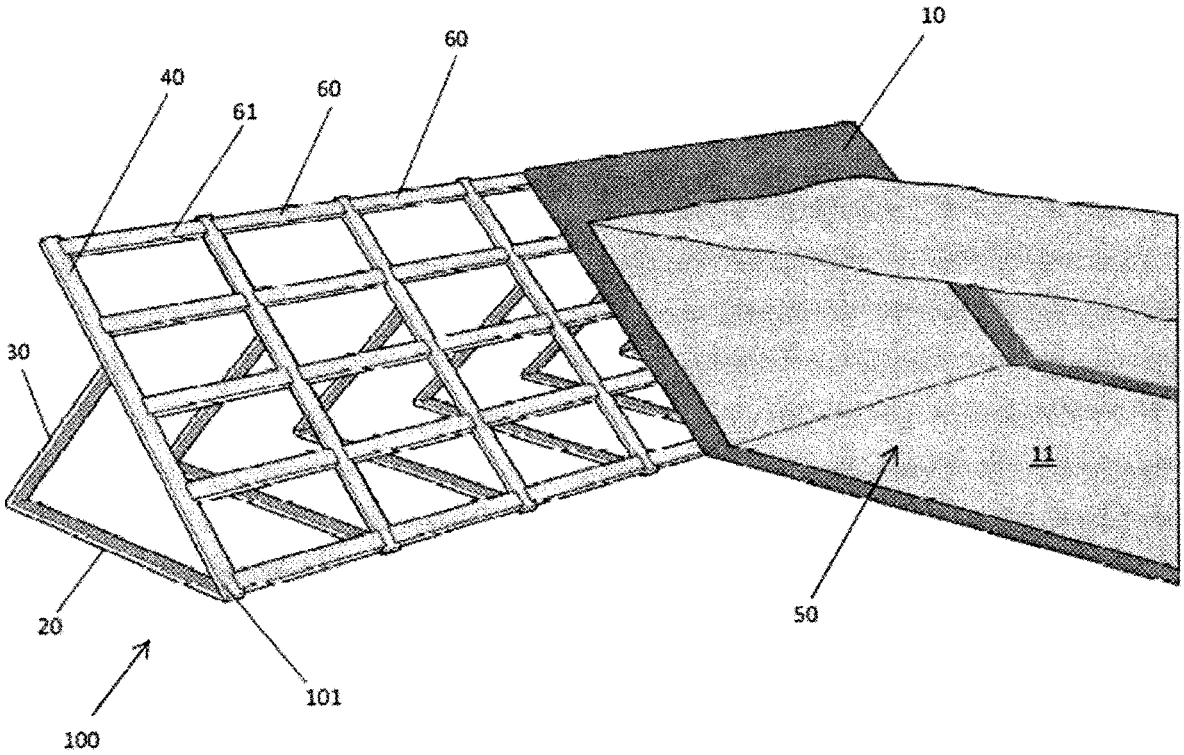
FIG. 2 is a perspective view of the system of FIG. 1 showing a liquid supported by the frame supporting units of FIG. 1, according to an embodiment of the present disclosure.
Figure 3:
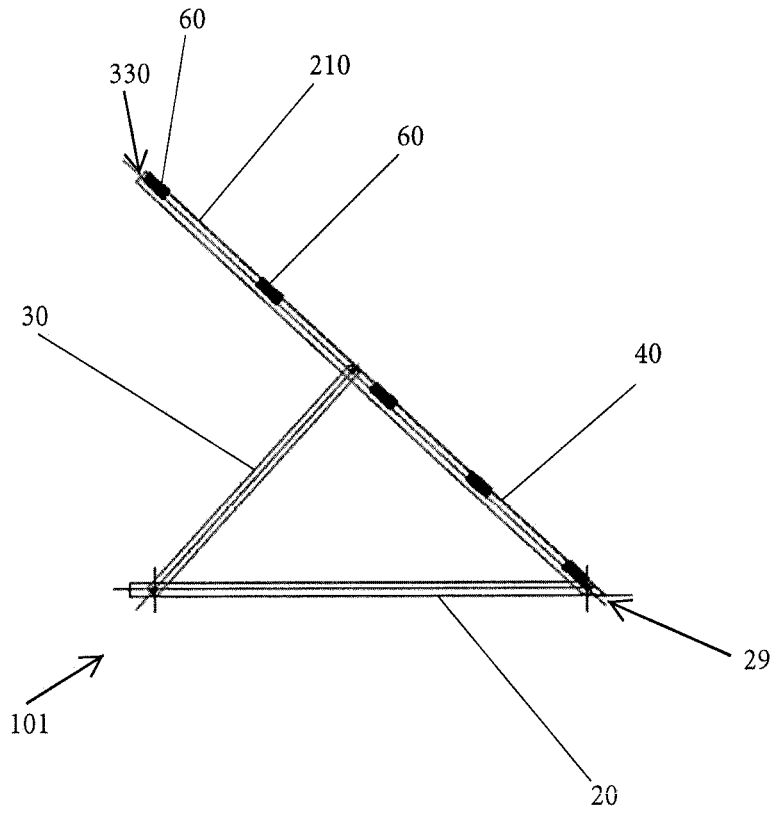
FIG. 3 is a side view of a frame unit of the frame units of FIG. 1, according to an embodiment of the present disclosure.

A plurality of instances of dam face 40 of frame units 100 may extend upwardly at an angle (e.g., about 43 degrees relative to a longitudinal axis of base 20) to support diversion system 5 and any contents of liquid portion 50 as depicted in FIGS. 2-3. The dam faces may be supported (e.g., in horizontal and vertical directions) by a plurality of braces (e.g., multiple instances of brace 30). The braces, bases and dam faces of frame units 100 may be formed of wood, metal or plastic members fastened to each other and configured to carry the weight of a liquid 11 (e.g., water from a flood) of diversion system 5 to control a flood, divert water, or otherwise inhibit a flow of water in a particular direction past such frame units, as depicted for example in FIG. 2. Such braces, bases and dam faces could also be monolithically formed (e.g., by molding, casting, etc.). For example, the braces, bases and dam faces may be formed of cold-formed steel members which would meet or exceed AISI S100-12, North American Specification for the Design of Cold-Formed Steel Structural Members.

Figure 15:
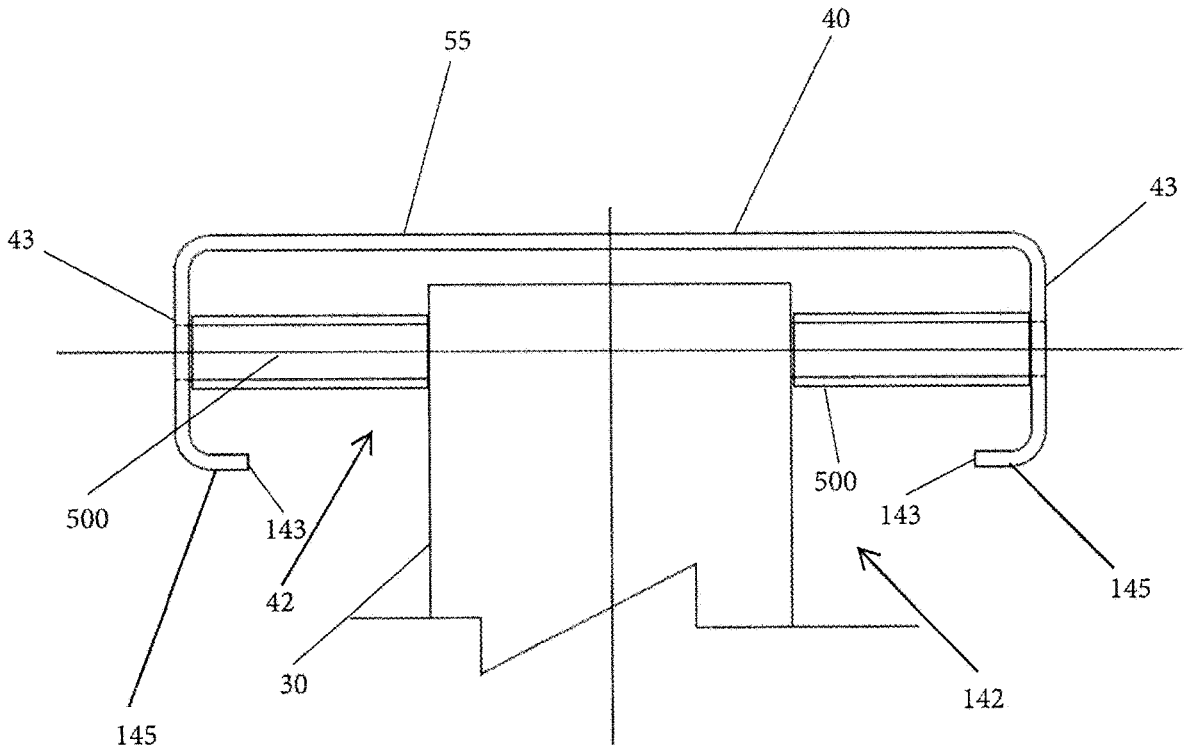
FIG. 15 is an end cross-sectional view of a dam face connected to a brace and utilizing a spacer according to the frame unit of FIG. 3, according to an embodiment of the present disclosure.

As depicted in FIGS. 4-7, such a dam face (e.g., dam face 40) may include a solid flat top surface 55, solid vertical sides 43, and return lips 145 (FIG. 15), forming a U-shape with an open bottom side forming a cavity 42 (FIG. 15). Return lips 145 may extend horizontally inwardly and may be located on bottom ends 44 of vertical sides 43 providing resistance to lateral and vertical deformation. The 43-degree angle described above of dam face 40 relative to base 20 depicted in FIGS. 1-3 provides for larger downward water pressure than horizontal water pressure thus insuring maximum grip of a frame unit (e.g., frame 101) to a substrate, such as a ground surface 1 (FIGS. 1-3). A toe 47 may be located at a bottom end of dam face 40 and may be shaped such that top surface 55 is longer than ends 44 of vertical sides in a longitudinal direction relative to a longitudinal dimension of dam face 40 as depicted in FIGS. 5-7.

Figure 4:
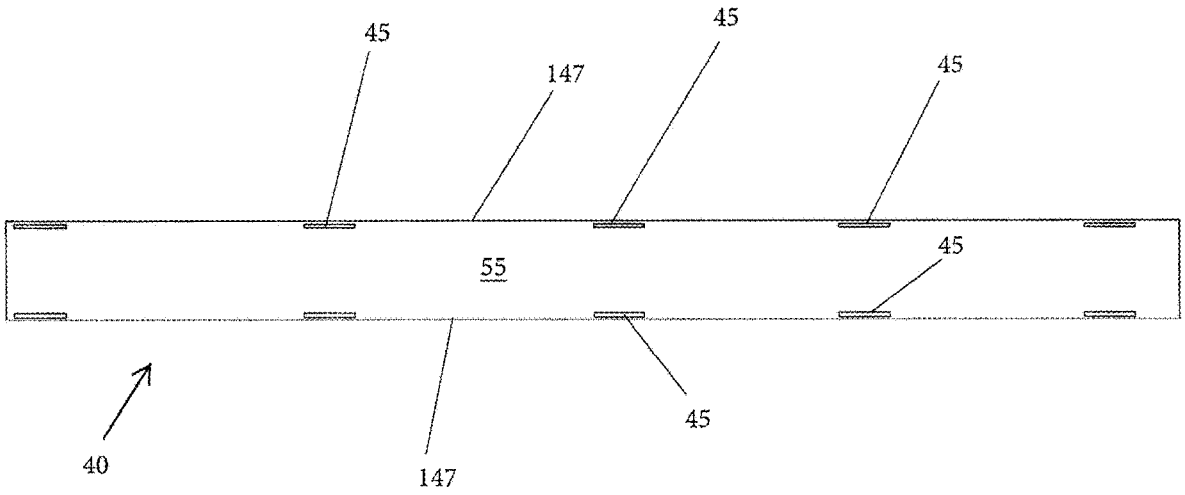
FIG. 4 is a top plan view of a dam face of the frame unit of FIG. 3, according to an embodiment of the present disclosure.

A dam face (e.g., dam face 40) may include slots 45 through top surface 55 thereof spaced along a longitudinal dimension of the dam face and located at both edges to receive a plurality of link bars 60 therein as depicted in FIGS. 4-5. For example, slots 45 (e.g., 10 slots) may be spaced longitudinally on top surface 55. Slots 45 may be spaced longitudinally along dam face 40 and may be spaced normal to a longitudinal axis of dam face 40 on or near opposite edges 147 of dam face 40. For example, five sets of two slots of slots 45 located on opposite edges 147 may be longitudinally spaced along dam face 40 as depicted in FIGS. 1-4. Such spacing of slots may be equal spacing longitudinally along dam face 40 or such spacing may be unequal. The slots may be spaced from an edge of the dam face, e.g., at a spacing from the edge to best accept the link bar configuration.

For example, a first link bar 61 of link bars 60 may connect dam face 40 to a second dam face 41, identical to dam face 40, of an adjacent frame 102 as depicted in FIGS. 1-3 and 8-10. Link bar 61 may be shaped and dimensioned to fit into slots 45. Other of link bars 60 may be identical to link bar 61. Multiple instances of link bar 61 or link bars 60 may connect multiple instances of frame unit 100 to each other. For example, link bars 60 may be fit into the dam face slots (e.g., slots 45) with a vertical downward motion when the frame is erected, with the angle of the dam face being 43 degrees, the insertion of the link bar would then be in a 43 degree angle to a vertical motion.

Figure 8:
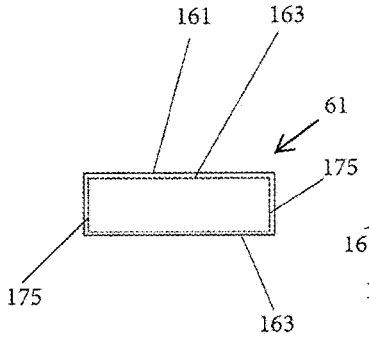
FIG. 8 is a left end view of a link bar of the frame unit of FIG. 3, according to an embodiment of the present disclosure.
Figure 9:
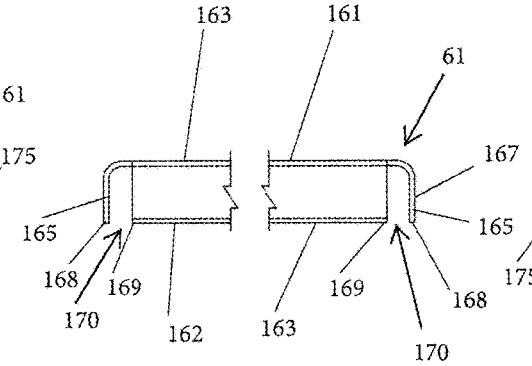
FIG. 9 is a side view of the link bar of FIG. 8, according to an embodiment of the present disclosure.
Figure 10:
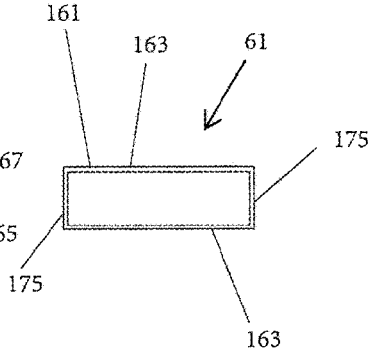
FIG. 10 is a right end view of the link bar of FIG. 8, according to an embodiment of the present disclosure.
Figure 11:
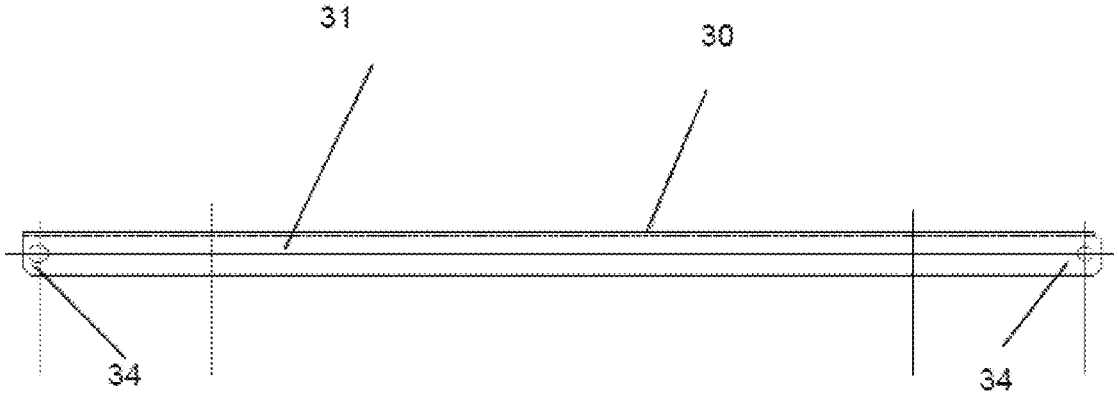
FIG. 11 is a side view of a brace of the frame unit of FIG. 3, according to an embodiment of the present disclosure.

Link bar 61 may include a hollow rectangular member except with ends thereof cut (or otherwise formed) so that only a first side 161 (e.g., a top side) of long flat sides 163 extends beyond a remaining solid rectangular bar shape as depicted in FIGS. 8-10, for example. In particular, first side 161 may include bent down lips or downwardly depending arms 165. A second side 162 (e.g., a bottom) of long flat sides 163 may have a longitudinal dimension smaller than first side 161 as depicted in FIG. 9, for example. Opposite sides 175 (e.g., lateral portions) may have longitudinal dimensions identical or similar to each other and identical or similar to the longitudinal dimension of second side 162 such that first side 161 is larger than the other sides and arms 165 extend longitudinally beyond the other sides. Arms 165 may be bent inwardly (e.g., downwardly toward second side 162) at a 90-degree angle with respect to a longitudinal dimension of link bar 61 so as to be longitudinally aligned perpendicular relative to first side 161. Ends 168 of downwardly depending arms 165 may be spaced by gaps 170 (e.g., a ⅜" gap) from ends 169 of second side 162. A shape and dimension of arms 165 and gaps 170 may correspond to a slot size of slots (e.g., slots 45) in a dam face (e.g., dam face 40), a location of the slots on the dam face (e.g., spaced 3/16 inch in from an edge thereof), and a shape of the dam face to allow engaging portions or ends (e.g., ends 168) of such link bars (e.g., link bars 60) to be received in the slots (e.g., slots 45) to connect frame units 100 to each other.

For example, all the link bars (e.g., link bars 60) used in a particular system (e.g., diversion system 5) may be similar or identical to each other to allow installation of the link bars in any sequence. Such uniformity may also promote ease of installation by a single laborer and provide rapid deployment and repeated reliability.

As indicated above, dam face 40 may connect to a brace (e.g., brace 30) at a distance slightly less than half a length from a top 144 of dam face 40 via pivot pins 46 (FIG. 5) connected (e.g., welded) to inside surfaces of vertical sides (e.g., sides 43) of dam face 40 and received in one of openings 34 (FIG. 11) of the brace to connect the dam face to the brace. The connection via a pinned connection allows a brace (e.g., brace 30) to rotate with respect to the Dam Face (e.g., dam face 40) during assembly or disassembly. More specifically pin 46 may be welded between opposite vertical sides 43 bounding cavity 42 (FIG. 15) of dam face 40 and brace 30 may include openings 34 to receive pin 46, such that the brace may rotate relative to the dam face. For example, pin 46 may be inserted through an opening in a first side of vertical sides 43 of the dam face, through openings 34 of brace 30 and through a second opening in a second side of vertical sides; and pin 46 may be welded to vertical sides 43 to secure pin 46 and brace 30

Brace 30 may be an inclined rectangular member connecting base 20 to dam face 40 as depicted in FIGS. 1-3 and 11-12, for example. Brace 30 may be connected to dam face 40 such that a longitudinal axis of brace 30 is at approximately 90 degrees relative to a longitudinal axis of dam face 40. This perpendicular connection may maximize the brace's ability to transfer water pressure forces from the dam face 40 to base 20 connected to brace 30. Brace 30 may be pinned to dam face 40 via holes 34 through a short side 31 corresponding to pin 46 in dam face 40 and may be pinned to Base 20 to allow brace 30 to experience compressive forces only (i.e., no moment force transfer).

Figure 12:
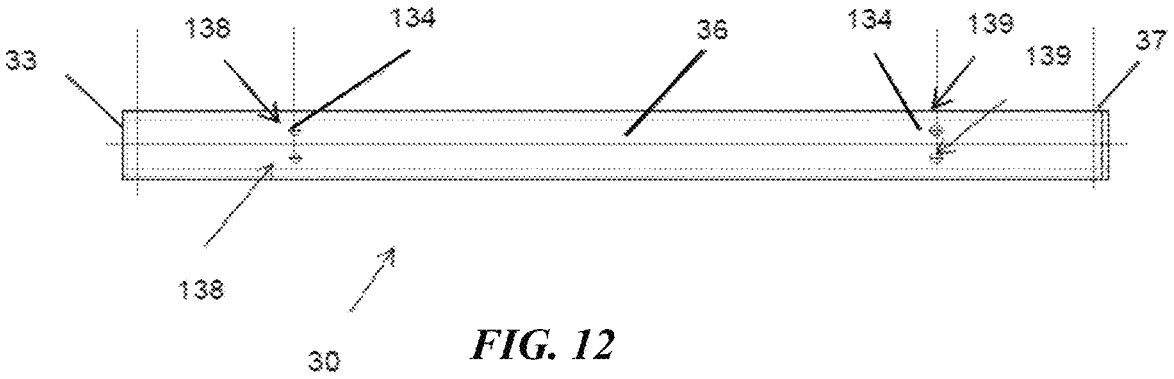
FIG. 12 is a top view of the brace of FIG. 11, according to an embodiment of the present disclosure.

Brace 30 may have four holes 134 drilled through a longer flat side 36 thereof as depicted in FIG. 12. In an example, two of holes 134 may be at a distance of six inches from a top 33 and two of holes 134 may be at a distance of six (6) inches from the bottom 37, for example. The adjacent holes may be spaced at approximately 1 inch apart in a direction normal to a longitudinal axis of brace 30.

Figure 22:
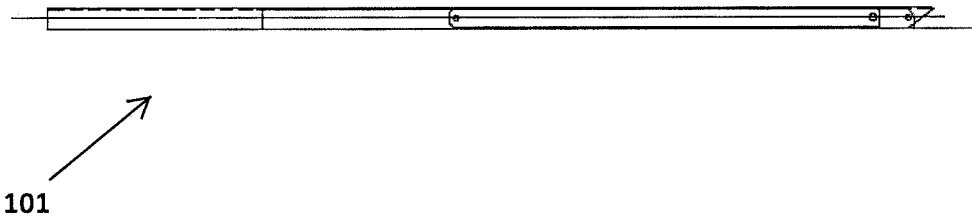
FIG. 22 is a side view of the frame unit of FIG. 3 in a folded configuration, according to an embodiment of the present disclosure.

A width of brace 30 may be sized to fold up into cavity 42 of dam face 40 during disassembly thereby creating a low, flat profile for stacking and storage, as depicted in FIG. 22 for example. Further, an outer dimension (e.g., a width dimension) of dam face 40 may be dimensioned such that the width of dam face 40 is less than a width of base 20 and may thus be received thereon to allow for folding and storage of frame 101 and frame units 100 in a minimal amount of space.

Figure 18:
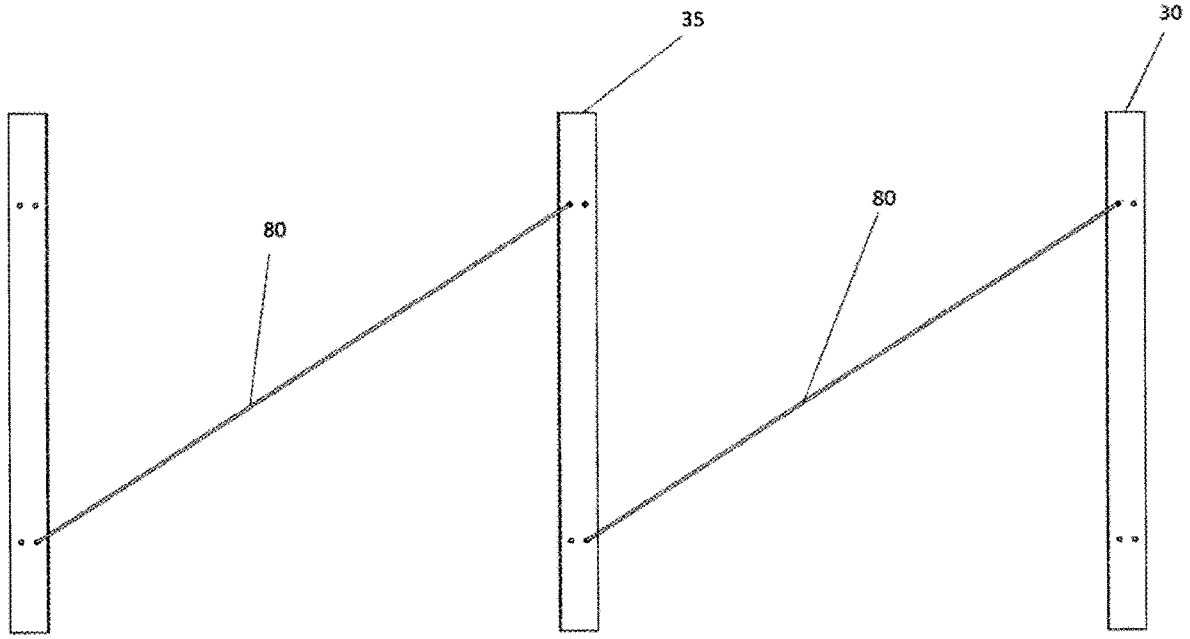
FIG. 18 is a rear view of three braces of FIG. 3 connected to each other via two of rod braces of FIG. 16, according to an embodiment of the present disclosure.
Figure 19:
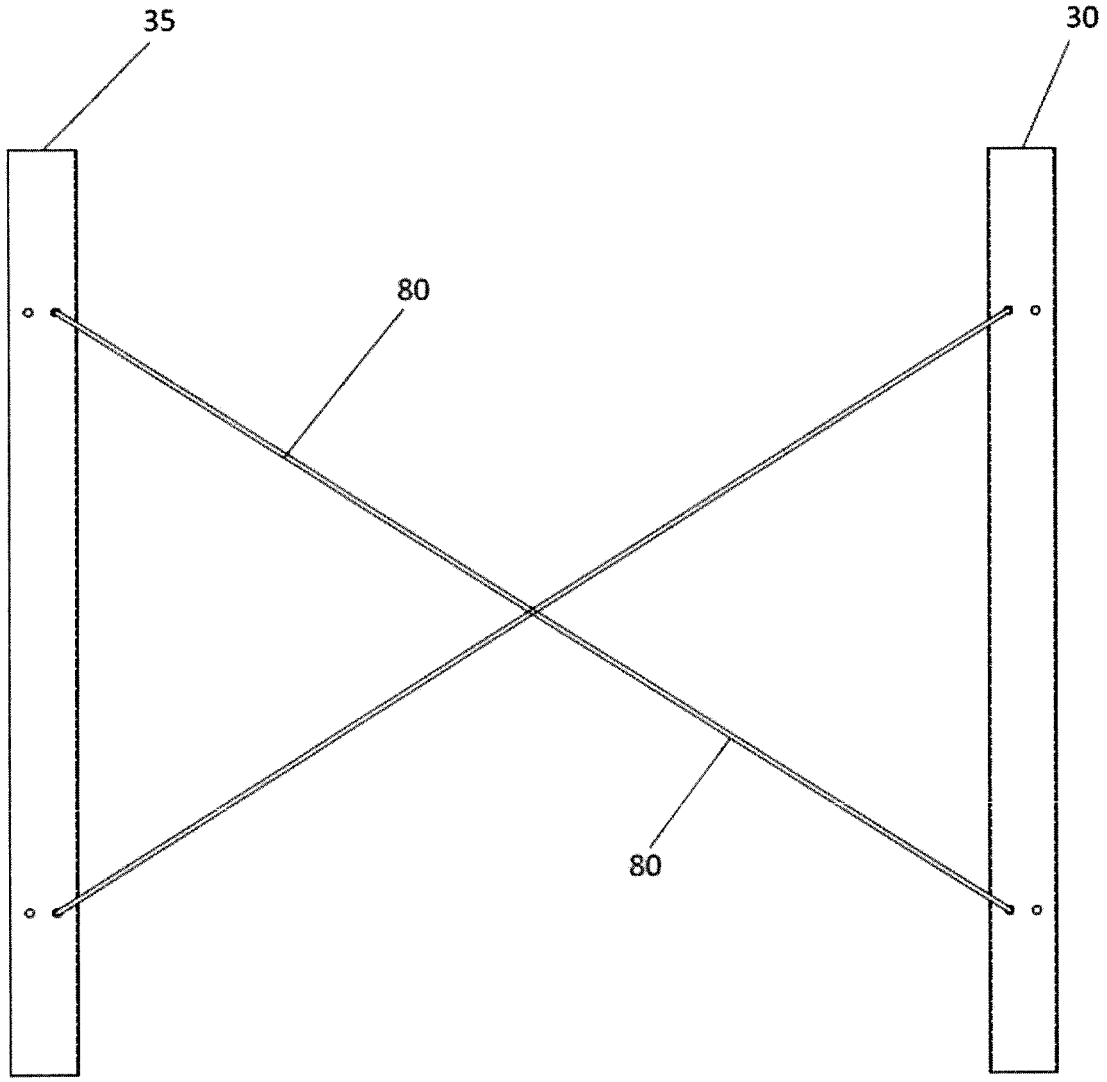
FIG. 19 is a rear view of two braces of FIG. 3 connected to each other via two of rod braces of FIG. 16, according to an embodiment of the present disclosure.
Figure 20:
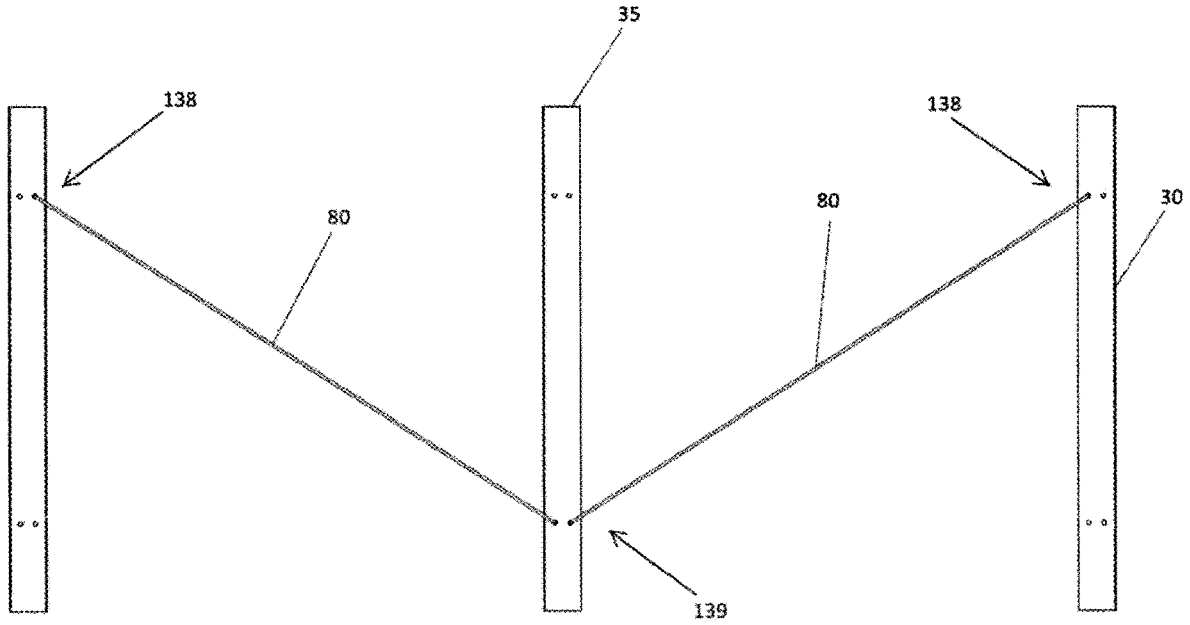
FIG. 20 is a rear view of three braces of FIG. 3 connected to each other via two of rod braces of FIG. 16, according to an embodiment of the present disclosure.

Holes 134 of brace 30 may be configured (e.g., sized, shaped, and dimensioned) to receive ends 82 of rod braces 80 as depicted in FIGS. 18-20, which depicts two instances of brace 30 spaced at an appropriate (e.g., 36 inches) distance to receive one or more rod braces-one of which is depicted in FIG. 19.

Figure 16:
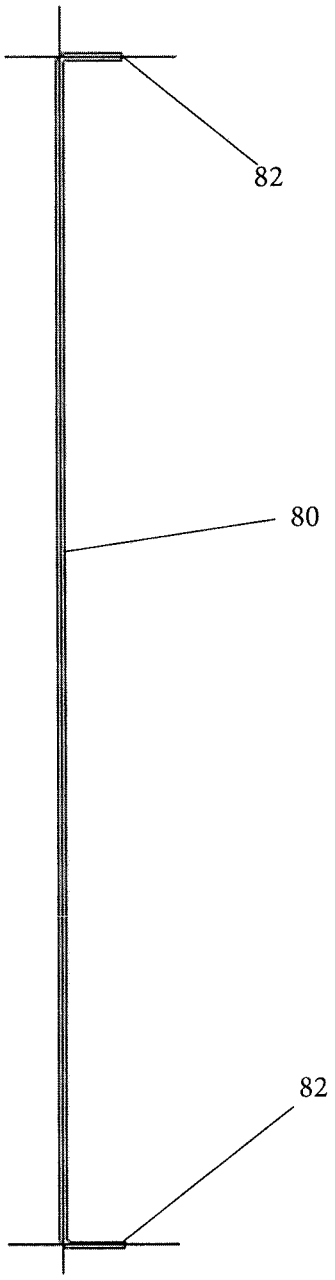
FIG. 16 is a side view of a rod brace connectable to the brace of FIG. 12, according to an embodiment of the present disclosure.

In an example, rod braces 80 may be formed of a ¼inch diameter rod with a 2⅛ inch bend at each end (e.g., ends 82) as depicted in FIG. 16. Bent ends (e.g., ends 82) of the rod brace may be inserted into the holes (e.g., holes 134 on longer flat side 36 of a brace (e.g., brace 30)) as depicted in FIGS. 12, 16, and 18-20. The locations and orientations of the rod braces (e.g., rod braces 80) relative to the braces (e.g., instances of brace 30) and frame units 100 may be dependent on field conditions encountered during erection of a system for diverting water (e.g., diversion system 5). For example, rod braces 80 may be inserted in top holes 138 of holes 134 of a first brace (e.g., brace 30) and bottom holes 139 of an adjacent brace similar or identical to the first brace (e.g., a brace 35, FIG. 1) and vice versa creating a "W" pattern (FIG. 20) or such rod braces (e.g., rod braces 80) may be inserted in an "X" pattern (FIG. 19) for horizontal stability as depicted in FIGS. 12 and 18-20, for example. Further, rod braces may be connected to braces such that a single rod brace connects adjacent braces (FIG. 18). For example, such rod braces (e.g., rod braces 80) may withstand enough tension so as to prevent settlement of a heal 28 (FIGS. 13-14) of base 20 when the base is installed on uneven surfaces thus maintaining an alignment of an overall structure (e.g., frame 101 or frame units 100).

Figure 13:
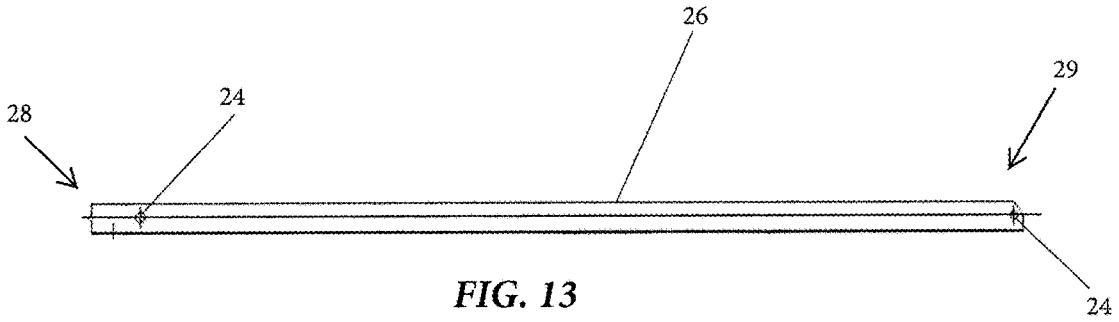
FIG. 13 is a side view of a base of the frame unit of FIG. 3, according to an embodiment of the present disclosure.
Figure 14:
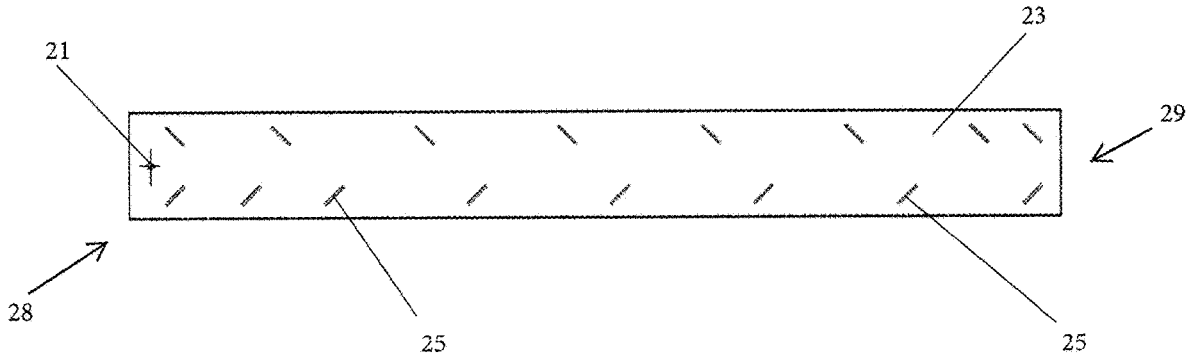
FIG. 14 is a top view of the base of FIG. 13, according to an embodiment of the present disclosure.

As described above, base 20 may be connected to dam face 40 and brace 20. Base 20 may be a member that has a horizontal (e.g., largely flat) bottom 23 and upward pointing vertical sides 26 bounding a base cavity to form a U-shape, as depicted in FIGS. 13-14. There are linear downward protrusions 25 through bottom 23 at specific locations and angles. These protrusions provide additional interface friction with a substrate (e.g., a ground surface) to inhibit or prevent horizontal movement of a system (e.g., diversion system 5) due to the water pressure. Protrusions 25 may be 1½ inches long by ⅛ inch wide with the material (e.g., steel) from the protrusion bent downward relative to a remainder of bottom 23 at a 45-to-85-degree angle. Longitudinal axes of protrusions 25 may be aligned at 45 degrees inward to a longitudinal axis of base 20. This orientation (i.e., alignment of protrusions 25) may cause the substrate to compact between opposing protrusions and increase an interface friction between base 20 and the substrate. Holes 24 may be drilled through vertical sides 26 of base at a toe 29 and at heal 28. Holes 24 are utilized for connecting (e.g., via bolts) base 20 to dam face 40 at toe 29 via holes 46 and for connecting base 20 to brace 30 via a quick release pin at heal 28. Further, a spike hole 21 may be located in bottom 23 of base 20 near heal 28 to receive a ground spike (not shown) therethrough in the case of severe conditions at a location of a system (e.g., diversion system 5).

Also, a width dimension of base 20 may be at least slightly wider than any other component (e.g., dam face 40 and brace 30), allowing an "A" frame unit (e.g., formed of dam face 40 with brace 30 received therein) to fold inside the base creating a low, flat profile for stacking and storage, as depicted for example in FIG. 22.

Liner 10 may be a continuous liner impermeable to liquids (e.g., water) and may be installed on frame units 100 as depicted in FIGS. 1-2, for example. Liner 10 may be configured (e.g., shaped and dimensioned) to fit the inside measurements (e.g., the inside surface of multiple instances of dam face 40 and base 20) of a desired number of frame units 100 to form diversion system 5 and extend over a top (e.g., a top 105) of frame units 100.

Liner 10 may be a geosynthetic membrane with adequate elongation properties so as to create a slight ballooning effect into cavities 200 between link bars 60 and instances of dam face 40 when the liner is installed on frame units 100 and water is received in a barrier or diversion system (e.g., diversion system 5) such that water and resulting water pressure is applied against liner 10. Such pressure may cause liner 10 to descend past top surface 55 of dam face 40 and/or first side 161 of long flat sides 163 of link bar 61, for example. Such elongation of liner 10 such that the liner may partially wrap around a link bar(s) (e.g., link bars 60) and instances of dam face 40 to inhibit movement of the link bars and instances of the dam face in a direction perpendicular to longitudinal dimensions thereof to providing an overall locking-together action.

Liner 10 may also include one-way air valves 220 on a substrate contacting portion 15 which may contact a concrete pad or ground surface (e.g., an irregular ground surface) on a portion thereof adjacent a diversion system (e.g., diversion system 5) when the diversion system is installed as depicted in FIG. 1, for example. Air pockets may occur between a liner (e.g., substrate contacting portion 15) and the ground (e.g., ground 1) during installation of such a containment system. The air pockets could be detrimental to the sealing and stability of the overall system. One-way air valves 220 strategically placed in the liner (e.g., liner 10) allows a release of trapped air bubbles from below the liner. The release of these trapped air bubbles may assure a tight seal to the ground or other surface and minimize a potential for liner slippage relative to the ground or other surface.

A low profile ballast 17 may be placed along a leading edge 18 of a run-out portion (e.g., substrate contacting portion 15) of a liner (e.g., liner 10) to maintain a position thereof during rising water conditions as depicted in FIGS. 1-2, for example. Ballast 17 may inhibit or prevent leading edge 18 of the liner from moving when first encountered by the rising water. The low profile minimizes a build-up of rising water in front of the leading edge (e.g., leading edge 18) of the liner (e.g., liner 10) allowing water onto a run-out portion (e.g., substrate contacting portion 15) thus quickly applying pressure on top of the liner to make secure a contact of the liner with the ground at a lowest level of the rising water. Ballast 17 may be received in a ballast pocket 19 of the liner (e.g., liner 10) or such ballast may be located on a top side thereof.

Elongation properties of a liner material and a puncture resistance strength thereof may allow for repeated impacts by floating debris without failure or leakage. Further, the flexibility and elongation properties of the liner material assure a tight seal between the liner and the substrate (e.g., ground 1) when deployed on uneven surfaces thus reducing or eliminating instances of leakage of water below the liner (e.g., liner 10).

Further, the liner may be any type of liner which may support the weight of water or another liquid when connected to frame units 100 and may be substantially impermeable. Also, liner 10 may be formed of a plurality of liner portions welded, overlapped, or otherwise connected to one another such that the seams are substantially impermeable.

Figure 17:
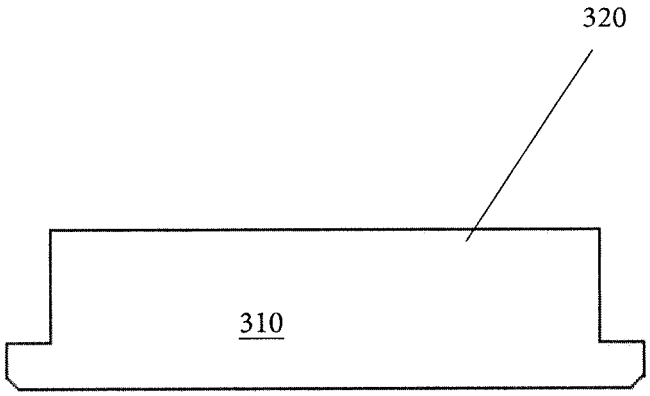
FIG. 17 is an end view of a wedge insertable into a cavity of the frame unit of FIG. 3, according to an embodiment of the present disclosure.

As depicted in FIGS. 1, 3 and 17, for example, liner 10 may be connected to frame units 100 via wedges 300 and liner clips 400. A wedge 310 of wedges 300 may be similar or identical to other of wedges 300 and may include a central stem portion 320 configured (e.g., shaped and dimensioned) to be received in a wedge cavity 330 (e.g., a top end of cavity 42) in a top 103 of frame 101 of frame units 100 while a remainder of wedge 310 may be located outside such a cavity. Wedges 300 may be formed of wood or plastic, for example.

As depicted in FIG. 1, during a set up a system for diverting water (e.g., diversion system 5) liner 10 may be located on frame units 100 and secured by a plurality of liner clips 400 located on top portion 12 of liner 10 at locations of instances of wedge 310 received in cavities (e.g., cavity 330) such that each clip contacts the liner on opposite sides (on a front and back of system 5) of each wedge to hold liner 10 on the frame units forming the system (e.g., diversion system 5). The liner clips may include two spring loaded members, similar to a clothes pin, with a first of the members contacting a front side of liner 10 toward liquid 11 as depicted in FIG. 2 while a second of the members contacts a rear side of liner 10. The liner may also be held on frame units 100 via other fasteners providing pressure on opposite sides of instances of wedge 310 to hold the liner thereon.

As described above, dam face may be U-shaped and may include cavity 42 of which cavity 330 forms a top end thereof. Wedge 310 located in cavity 330 provides a structure for the liner clip to hold liner 10 against in the cavity. More specifically, the liner clip may provide a force on the front side of system 5 against liner 10 on top surface 55 of dam face 40 and on a rear side on liner 10 against wedge 310 received in cavity 330. The liner clip may thus hold liner 10 in place an inhibit the liner from moving downwardly along the front side (e.g., top surface 55 of dam face 40) of system 5.

As indicated above, wedge 310 may be formed of wood, plastic or another material which may provide a rigid structure in a cavity (e.g., cavity 330) to allow a frictional effect when a fastener (e.g., a clip) is attached to outside opposite surfaces of the liner and wedge, and further the wedge may be formed to minimize or inhibit damage to the liner due to contact thereof with frame units 100. For example, when frame units 100 are formed of steel, a use of wedge 310 may inhibit a likelihood of an edge of the metal forming one of frame units 100 from puncturing or cutting a liner (e.g., liner 10) received thereon due to the contact of the liner with the wedge (instead of the frame unit), since the wedge is formed of a material providing structure but not having a surface likely to cause damage to the liner even when placed under a stress or force.

As depicted in FIG. 15, spacers 500 may be utilized to facilitate a connection of brace 30 to dam face 40. In particular, dam face 40 may include cavity 42 bounded by solid flat top surface 55 and solid vertical sides 43 as described above. Pins 46, or other fastening members, may be connected to vertical sides 43 to connect brace 30 to dam face 40, as described above, for example. Spacers 500 may be received on opposite sides of such a fastening member within cavity 42 and with brace 30 between such spacers to inhibit or prevent lateral movement of brace 30 that may otherwise cause a contact of brace 30 with inside surfaces 143 of return lips 145 bounding an opening 142 into cavity 42 as depicted in FIG. 15. For example, spacers 500 may be received on pin 46 as pin 46 is inserted through openings 34 of brace 30 and prior to welding of pin 46 to vertical sides 43 of dam face 40 as described above.

Figure 21:
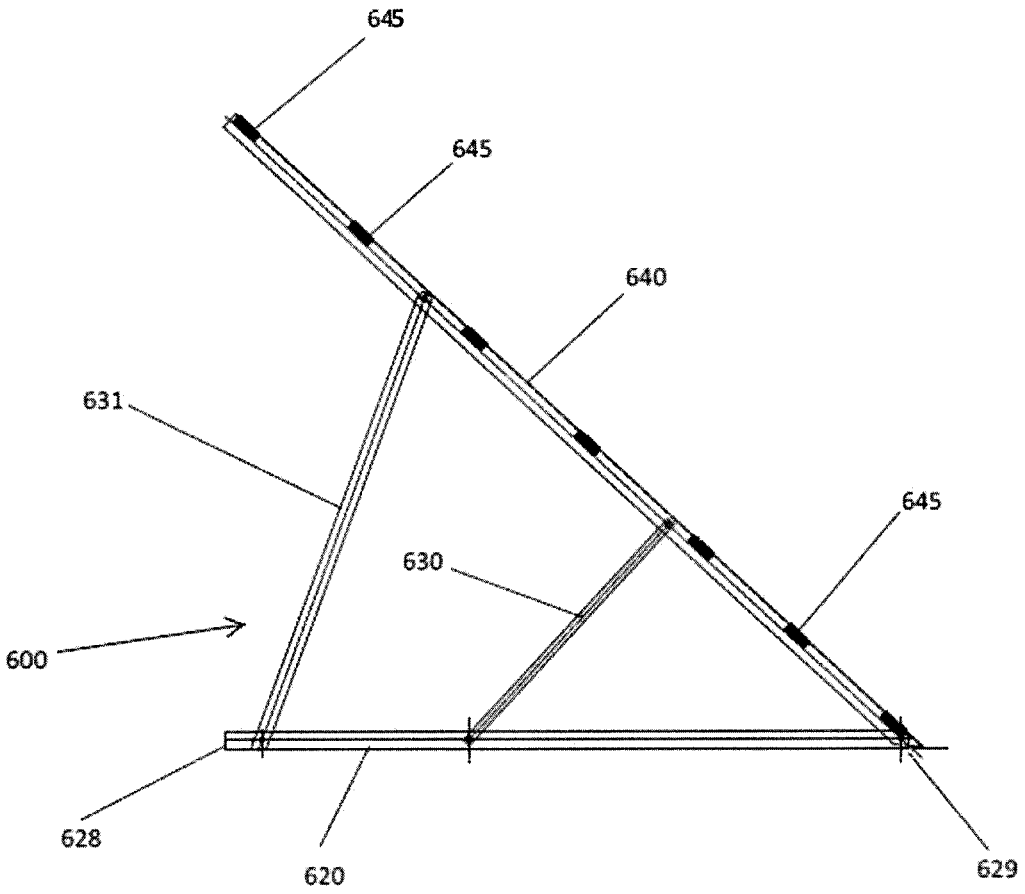
FIG. 21 is a side view of another example of a frame unit having two braces to support a dam face, according to an embodiment of the present disclosure.

In an example depicted in FIG. 21, a frame 600 may be similar to frame 101 including a dam face 640, a brace 630 and a base 620. Further a second brace 631 may be located toward a heal 629 relative to brace 630. Second brace 631 may be aligned at a smaller angle than brace 630 relative to a longitudinal axis of dam face 640. Dam face 640 may include multiple slots 645 (e.g., 7 slots) to receive link bars (e.g., link bars 60) as described above relative to frame units 100. Frame 600 may have a large height (e.g., 60 in. or 72 in.) relative to frame units 100 (e.g., 36 in. or 42 in.) such that the use of two braces and additional link bars relative to frame units 100 may be desirable. For example, the use of two braces may provide additional support to dam face 640 relative to dam face 40 described above and thus may allow frame 600 to divert water at a height of water larger than frame 101 described above.

The above described systems (e.g., diversion system 5) and methods may be used for the temporary short or long term diversion of any form of liquid or slurry. Such systems are intended to be used above ground and are portable. In particular, the frame units (e.g., frame units 100) and separate hardware (e.g., pins) may be individually stacked and transported by truck to any location including very remote locations. The systems may be easily assembled, broken down and re-assembled at different locations. As described above, a brace (e.g., brace 30) may be received in a cavity (e.g., cavity 42) of a dam face (e.g., dam face 40) and the dam face may be connected to and/or received on a base (e.g., base 20) to allow stacking of instances (e.g., frame 101) of the frame units (e.g., frame units 100), as depicted in FIG. 22 for example. Further, each of frames 100 may be releasably connected to adjacent frames of frames 100 to form the structure of a system for water diversion (e.g., system 5) by a plurality of link bars (e.g., link bars 60) thereby allowing a system to be constructed in various sizes and shapes (e.g., by using different number of frame units 100 in different configurations) and allowing the easy deconstruction and movement of such a system from one place to another due to the releasable nature of the connections. The frames (e.g., frame units 100) may also be separated from each other and re-used after a system has achieved a particular purpose, for example. The assembly and re-assembly may be done by hand and/or with the assistance of lifting machinery.

Such systems for water diversion (e.g., diversion system 5) may be completely modular (e.g., multiple frame units 100 and liner 10 may form different shapes and sizes) and may be constructed into any shape or size configuration (e.g., 36 in. 48 in., 60 in. or 72 in. height) based on needs (e.g., water flow to be diverted) of a particular situation.

Figure 23:
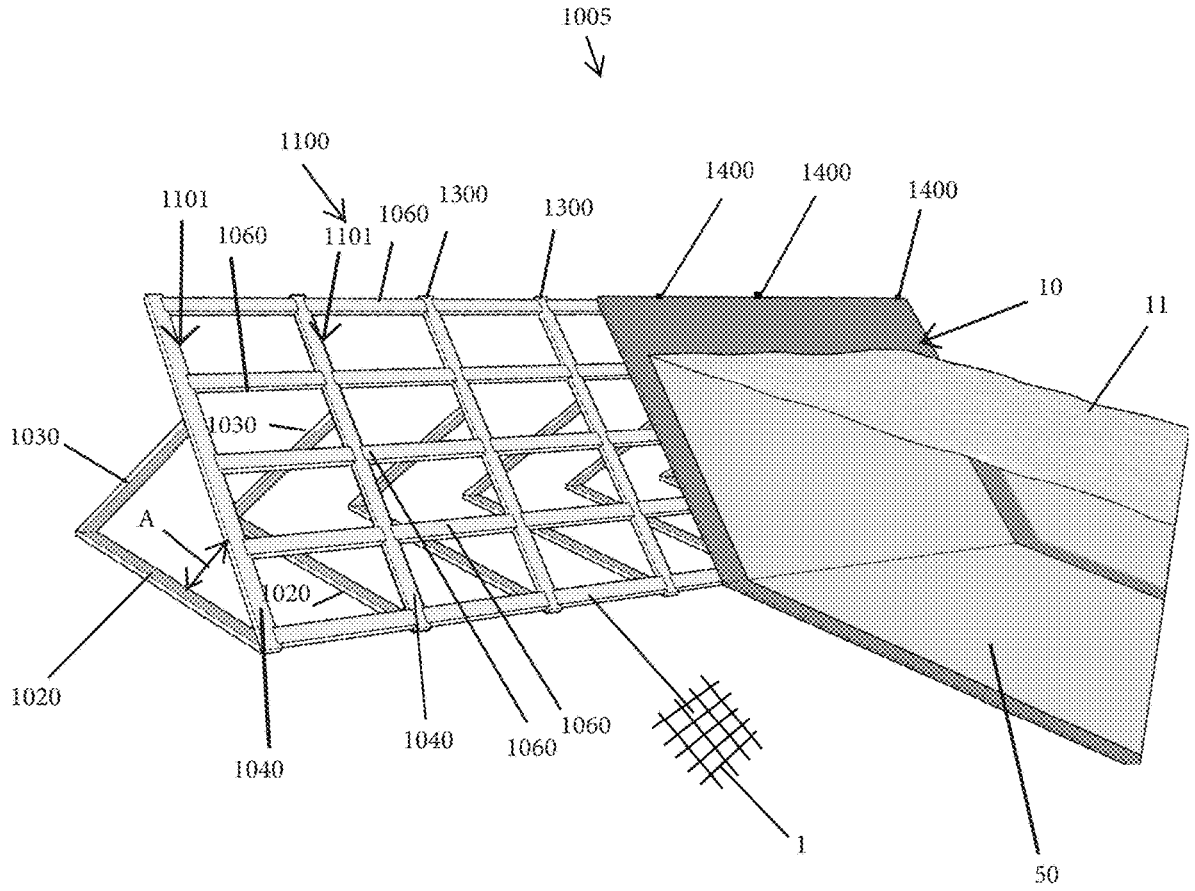
FIG. 23 is a perspective view of a rapid deployment flood protection system for diverting a liquid including supporting structures for supporting a liner, according to an embodiment of the present disclosure.

FIG. 23 illustrates, a rapid deployment flood protection and/or diversion system 1005, which may be quickly and readily set up as a water barrier, and/or according to an embodiment of the present disclosure. Rapid deployment flood protection or diversion system 1005 could be any type of water diversion barrier system, such as a water diversion structure, dam, flood control structure, or other structure for inhibiting or preventing movement of water through the barrier system toward an undesired area or areas.

System 1005 may be configured (e.g., shaped and dimensioned) to any shape and to various heights. System 1005 may include a series of interconnected frame units or support structures 1100 (one of which is shown in FIG. 23) spaced at intervals erected on a prepared surface 1 (e.g., a concrete pad) or an irregular surface (e.g., a ground surface) to form a container skeleton or support structure for supporting a liner 10. For example, dam face 1040 may have a length of about 78 inches, or other suitable length.

For example, support structure 1100 may include a plurality of spaced-apart frames 1101 along with a plurality of linking bars 1060. The components of the plurality of frames 1100 may be assembled with connectors. The connectors may include pins or quick release connectors.

Figure 24A:
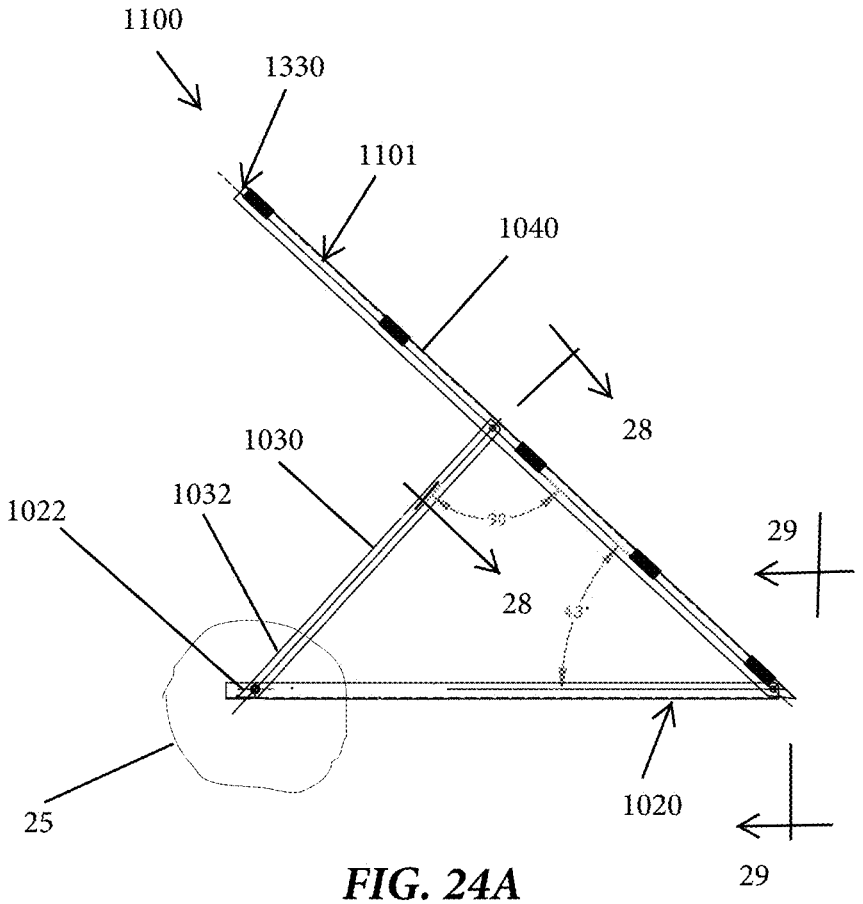
FIG. 24A is a side elevational view of the supporting structure of FIG. 23, according to an embodiment of the present disclosure.
Figure 24B:
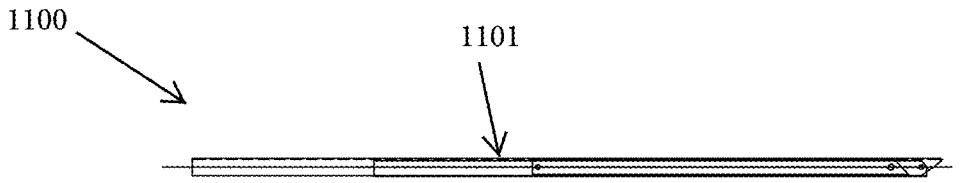
FIG. 24B is a side view of the supporting structure of FIG. 24A disposed in a collapsed configuration, according to an embodiment of the present disclosure.

As shown in FIGS. 24A and 24B, support structure 1100 may have a deployed, usable, or extended configuration generally having an A-frame configuration and a collapsed configuration as shown in FIG. 24B, according to an embodiment of the present disclosure. With reference again to FIGS. 23 and 24A, support structure 1100 may include the plurality of frames 1101 having fixed pivotable connections and quick release connections that allows support structure 1100 to be quickly and readily set up in the deployed configuration from the collapsed configuration, which collapsed configuration is readily and easily stored and transported to a desired site for use. As further described below, frames 1100 may include stops that allow support structure to be temporarily raised and disposed in a secure, expanded usable configuration prior to installing the quick release pins and locking the support structures in the deployed configuration.

As shown in FIG. 23, support structures 1100 may include a brace 1030 and a dam face 1040 facing a wet side portion 50 of the system 1005, which may hold liquid such as water to inhibit movement thereof in an undesired direction. A base 1020 may connect brace 1030 and dam face 1040.

A plurality of instances of dam face 1040 of support structure 1100 may extend upwardly at an angle A (e.g., about 43 degrees relative to a longitudinal axis of base 1020) to support system 1005 and any contents of liquid portion 50. The dam faces may be supported (e.g., in horizontal and vertical directions) by a plurality of braces (e.g., multiple instances of brace 1030). The braces, bases, and dam faces of support structure 1100 may be formed of wood, metal or plastic members fastened to each other and configured to carry the weight of a liquid 11 (e.g., water from a flood) of system 1005 to control a flood, divert water, or otherwise inhibit a flow of water in a particular direction past such support structures. Such braces, bases, and dam faces could also be monolithically formed (e.g., by molding, casting, etc.). For example, the braces, bases, and dam faces may be formed of cold-formed steel members which would meet or exceed AISI S100-12, North American Specification for the Design of Cold-Formed Steel Structural Members.

Dam faces 1040 may be configured essentially the same as dam faces 40 (FIG. 1), link bars 1060 may be configured essentially the same as link bars 60 (FIG. 1), base 1020 may be configured essentially the same as a base 20 (FIG. 1), and braces 1030 may be configured essentially the same as brace 30 (FIG. 1), with the exceptions as noted below. The dam faces and the link bars may be assembled as described above. As will be appreciated from the description below, the connections between the dam faces, bases, and braces of system 1005 allow system 1005 to be rapidly deployed.

Figure 25:
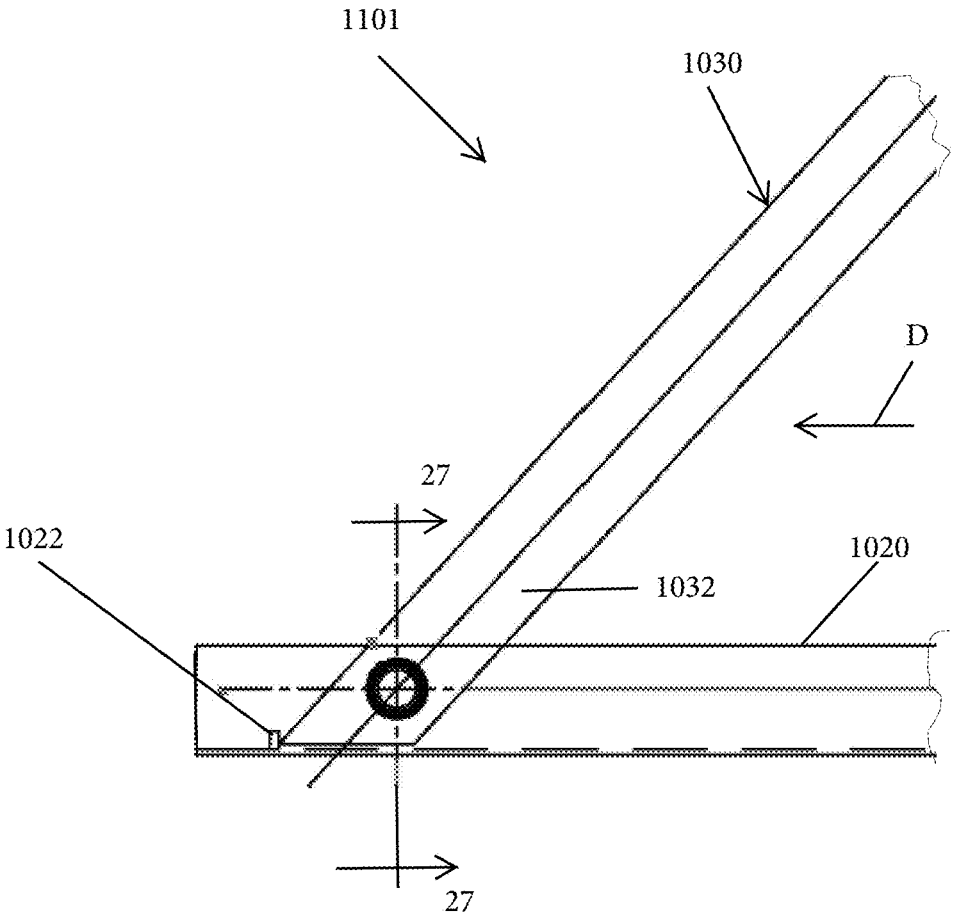
FIG. 25 is an enlarged view of Detail 25 shown in FIG. 24A, according to an embodiment of the present disclosure.

With reference to FIGS. 24A and 25, base 1020 may include a bump stop 1022, according to an embodiment of the present disclosure. Bump stop 1022 may be an upwardly extending projections or portion on base 1020 that may be located on the upper inside surface of base 1020 such that when erecting supporting structure 1100, a lower end 1032 of brace 1030 may be slid on base 1020 in the direction of arrow D until lower end 1032 of brace 1030 contacts bump stop 1022. At such location, bump stop 1022 may hold brace 1030 and dam face 1040 erect, and a pin such as a quick release pin may be employed for connecting brace 1030 to base 1020 as described in greater detail below.

In some embodiments, bump stop 1022 may be a ⅛ inch×⅜ inch×1½ inch long steel flat bar with the ⅛ inch edge welded to the upper inside surface of base 1020, perpendicular to base 1020 vertical flanges, and centered between base 1020 vertical flanges. As noted above, the purpose of the bump stop is to assist in the field when erecting system 1005 (FIG. 23).

Figures 26A, 26B, 26C:
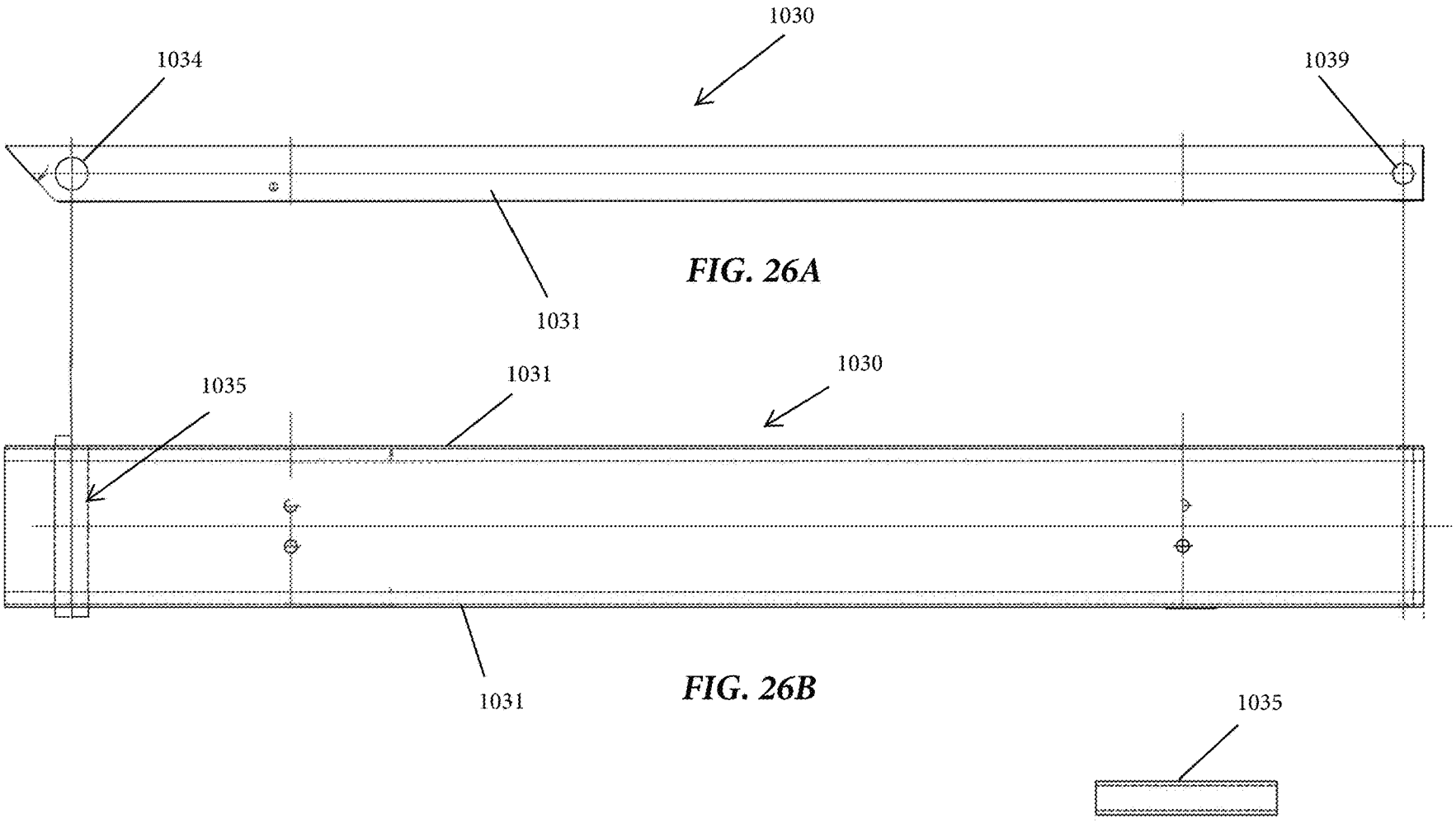
FIG. 26A is an enlarged side elevation view of the brace of FIG. 23, according to an embodiment of the present disclosure.
FIG. 26B is a top view of the brace of FIG. 26A, according to an embodiment of the present disclosure.
FIG. 26C is a cross-sectional view of the sleeve of the brace of FIG. 26B according to an embodiment of the present disclosure.
Figure 27:
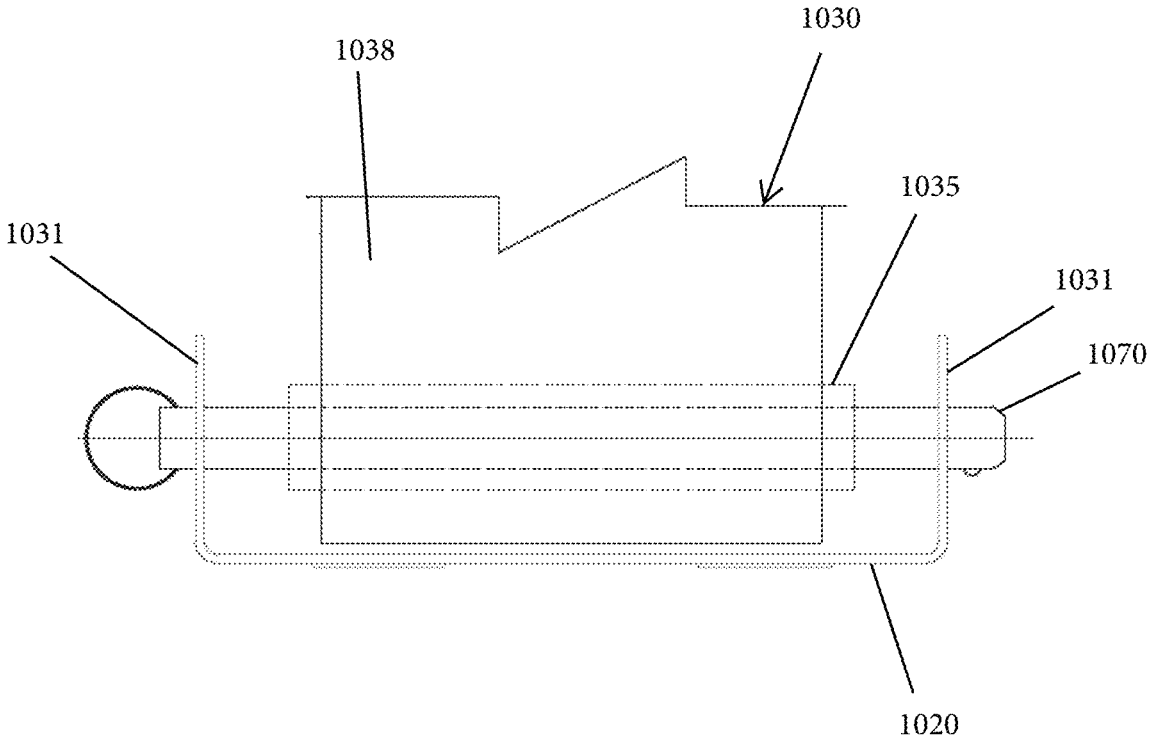
FIG. 27 is an enlarged cross-sectional view taken along line 27-27 in FIG. 25 of the connection between the brace and the base, according to an embodiment of the present disclosure.

As shown in FIGS. 26A and 26B, brace 1030 may include a hollow sleeve 1035 having a passageway therein that extends between holes 1034 (one of which is shown in FIG. 26A) in flanges 1031 for, as shown in FIG. 27 receiving a quick release pin 1070 at first end or heal end 1038 of brace 1030. Sleeve 1035 may be welded to opposite sides of brace 1030 and may receive quick release pin 1070. For example, the sleeve may aid insertion of the quick release pin as it is in alignment to guide the quick release pin insertion through the vertical flanges of base 1020. Further, sleeve 1035 may distribute a load from brace 1030 more uniformly across the quick release pin relative to an example without such a sleeve where a load would be concentrated on the upwardly extending portions of base 1020 at the location of the holes therethrough receiving a pin.

With reference to FIGS. 26C and 27, in some embodiments, sleeve 1035 may be a Drawn Over Mandrel (DOM) steel pipe. Sleeve 1035 may be 4½ inches long and welded into heel end 1038 of brace 1030 with a ¼ inch protruding past each side or flange of brace 1030. Sleeve 1035 may have two purposes as noted above. First, the sleeve may aid in the assembly of the "A" frame supporting structures. Once the "A" frame supporting structures is opened and heal 1038 of brace 1030 is placed against bump stop 1022 (FIG. 25), sleeve 1035 is in alignment to guide the quick release pin 1070 insertion through the vertical flanges of base 1020. Second, sleeve 1035 may structurally distribute the load from brace 1030 more uniformly across quick release pin 1070 assuring true pin double shear conditions and minimizing the potential of point load bending of the quick release pin.

Figure 28:
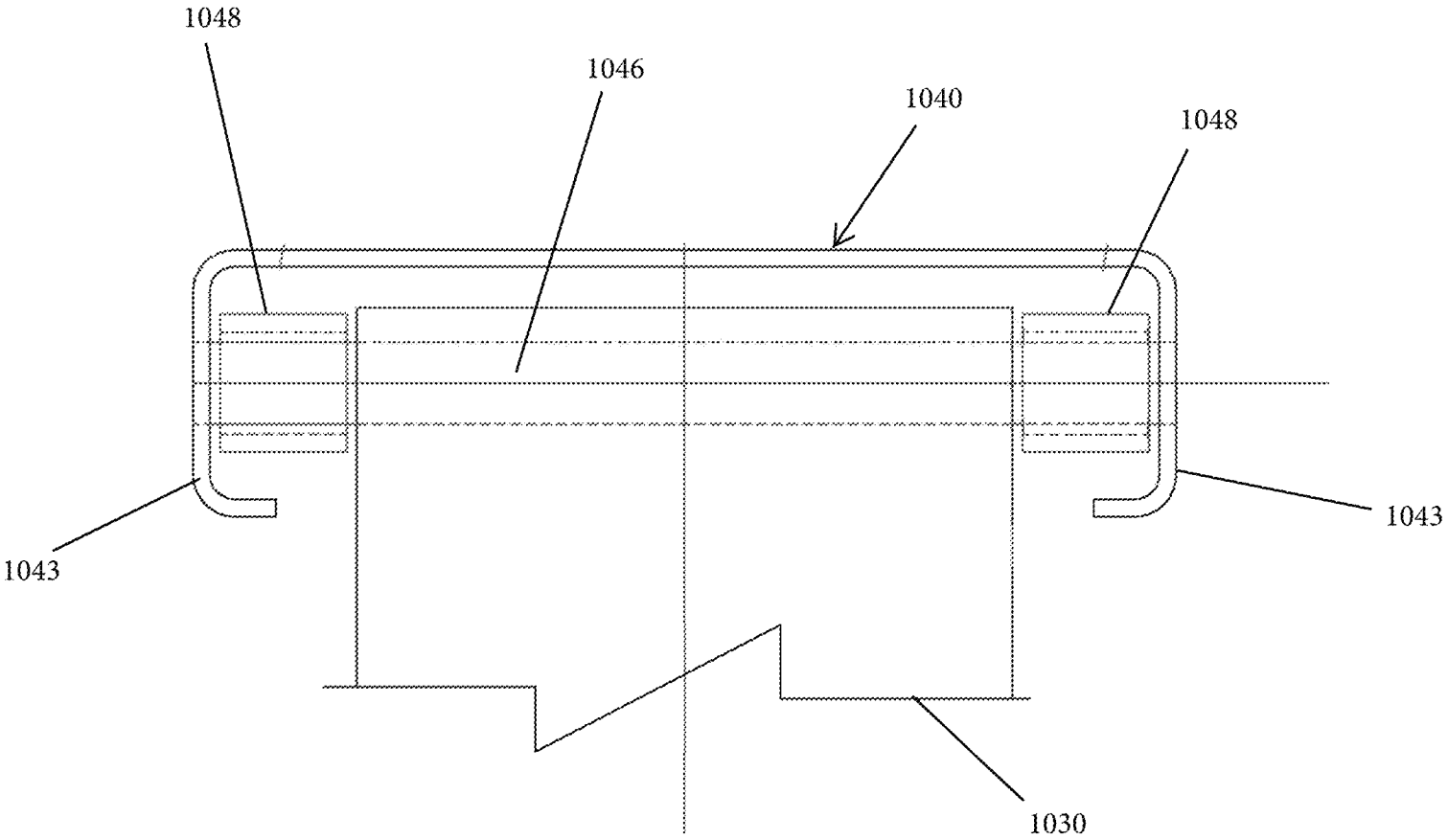
FIG. 28 is an enlarged cross-sectional view taken along line 28-28 in FIG. 24A of the connection of the dam face to the brace, according to an embodiment of the present disclosure.

As shown in FIG. 28, dam face 1040 may be fixedly pivotally connected to brace 1030 generally at a distance slightly less than half a length from the top of dam face 1040 via a pivot connection, according to an embodiment to the present disclosure. In this illustrated embodiment, the pivot connection may include a pin 1046 and spacers 1048 located thereon and between brace 1030 and inside surfaces of dam face 1040 to maintain brace 1030 in a central position relative to a width of dam face 1040. Pin 1046 may be connected (e.g., welded) to outside surfaces of vertical sides (e.g., sides 1043) of dam face 1040 and received in one of openings 1039 (FIG. 26A) of brace 1030 to connect dam face 1040 to brace 1030. The pivot pin may initially be assembled with the dam face by threading the pin through an opening in a side of the dam face, an opening in a first spacer, openings in the brace, an opening in a second spacer, and an opening in a second side of the dam face followed by welding of the pin to outside surfaces of the two sides of the dam face.

In some embodiments, pin 1046 may be a ½ inch diameter ASTM A36 steel rod welded to the outside of the two vertical flanges of the dam face. The welded pivot pin eliminates the potential of the liner snagging on a protruding bolt head and nut during operation and causing damage to the liner. The welded pivot pin also provides a uniform width to the "A" frame assembly for ease of stacking during storage, removal from storage during transport, and at site during installation. The spacers may aid or assure that the brace stays or is maintained in the center of the dam face during installation and operation. Maintaining a centered position assures more predictable engineering design and analysis resulting in a more uniform loading of the forces through the brace to the base.

Figure 29:
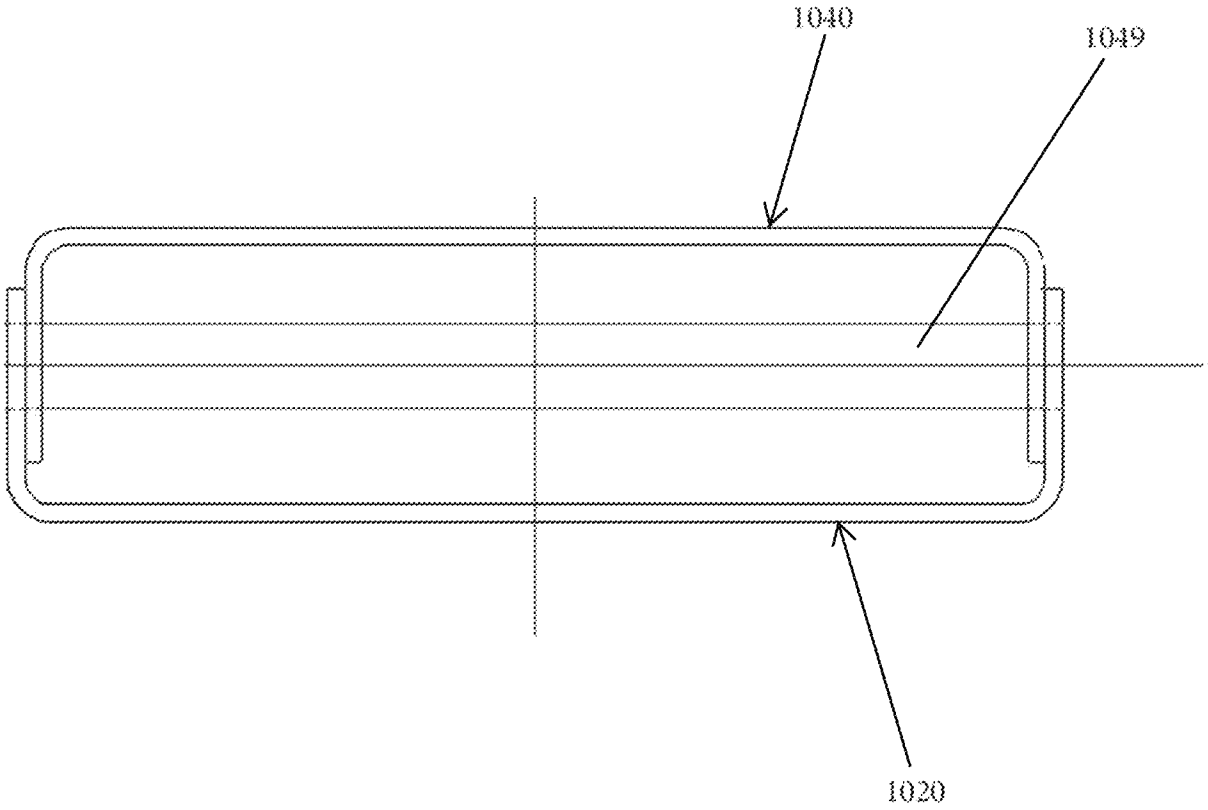
FIG. 29 is an enlarged cross-sectional view taken along line 29-29 in FIG. 24A of the connection of the dam face to the base of the frame, according to an embodiment of the present disclosure.

As shown in FIG. 29, the toe end of dam face 1040 may be fixedly pivotally connected to base 1020 via a pin 1049, according to an embodiment of the present disclosure. Pin 1049 may extend between holes in the flanges of dam face 1040 and holes in the flanges of base 1020 and be welded to opposite flanges of base 1020.

In some embodiments, pin 1049 may be a ½ inch diameter ASTM A36 steel rod welded to the outside of the two vertical flanges of the base. The welded pivot pin may eliminate the potential of the liner snagging on the welded pivot pin compared to a protruding bolt head and nut during operation and causing damage to the liner. The welded pivot pin also provides a uniform width to the "A" frame assembly for ease of stacking during storage and removal from storage during transport and at site when erected.

Figure 30:
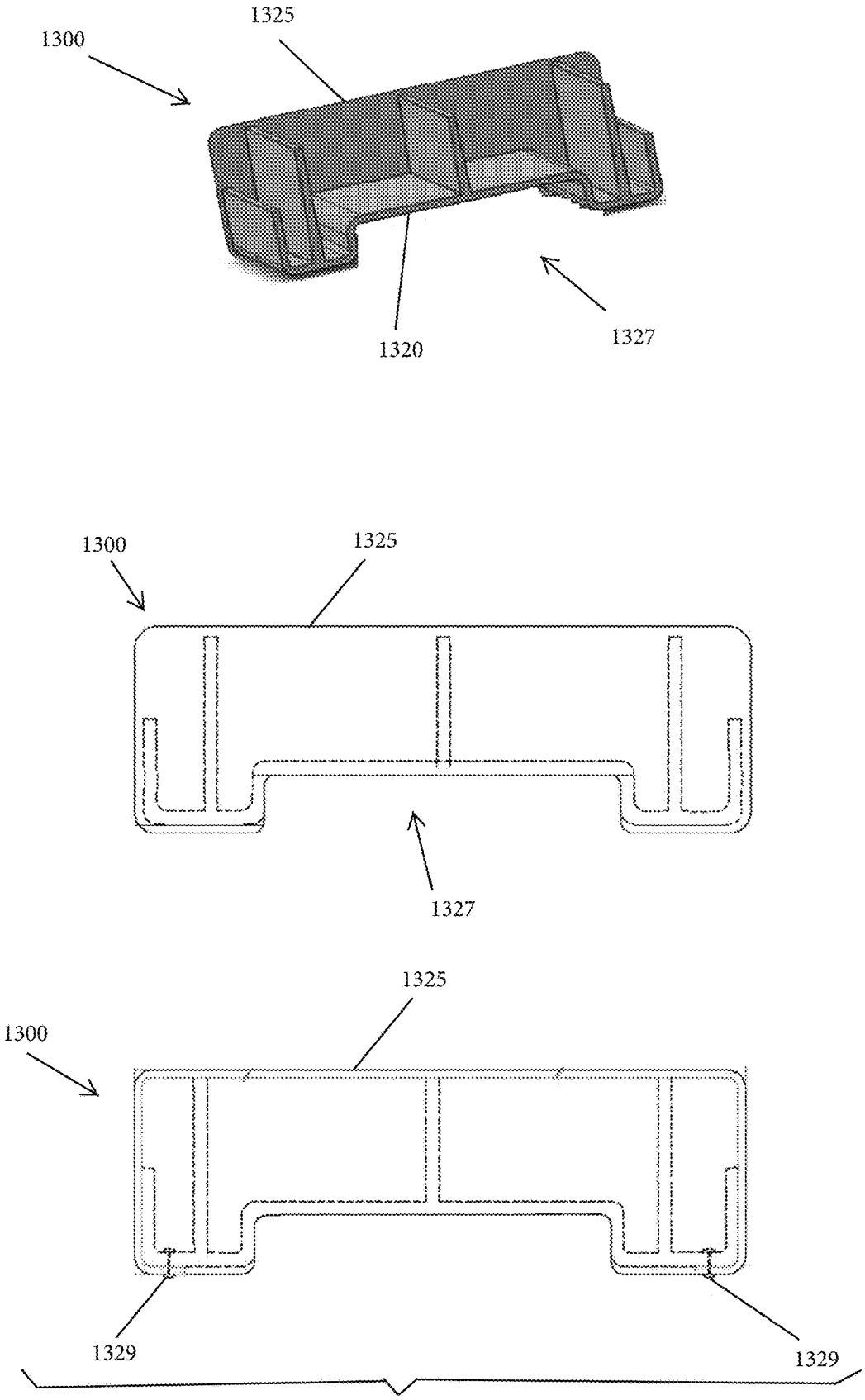
FIG. 30 are enlarged perspective view, top view, and top inserted view of a wedge of the frame of FIG. 23, according to an embodiment of the present disclosure.

FIG. 30 illustrates a wedge 1300, according to an embodiment of the present disclosure. Liner 10 (FIG. 23) may be connected to frame units or support structures 1100 via wedges 1300 and liner clips 1400 (FIG. 23). Wedge 1300 may be configured (e.g., shaped and dimensioned) to be received in, as shown in FIG. 24A, a wedge cavity 1330, e.g., a top end of dam face 1040, in frames 1101 of support structures 1100. With reference again to FIG. 30, wedge 1300 may include a central stem portion 1320 and a cap or lid 1325, which cap or lid may be located outside the cavity in the dam face. Cap or lid 1325 may include an indentation 1327. In some embodiments, an indentation need not be provided. Wedges 1300 may be generally hollow molded plastic wedges, which provides uniformity to the wedge dimensions through the molding process. In addition, the plastic wedges may eliminate the potential for dry splintering and limiting expansion/contraction compared to wedges fabricated from wood due to water adsorption and drying. The wedge and liner clips may be connectable to secure the liner as described above. For example, fasteners 1329 may be employed to connect and restrain cap or lid 1325 to the upper end of the dam face.

With reference again to FIG. 23, during installation of flood protection or diversion system 1005, initially supporting structure 1100 is disposed in a collapsed configuration (as shown in FIG. 24B) with dam face 1040 folded into base 1020 and with brace 1030 folded up inside dam face 1040. During construction or deployment of flood protection or diversion system 1005, the collapsed supporting structure is laid on the surface with the dam face 1040 on top and base 1020 (with the cleats) disposed in a downward position or orientation. Dam face 1040 is lifted and rotated around the toe pin until the brace is about 90 degrees to the dam base. The dam brace is then rotated around the pivot pin while the dam face is raised until the brace heel contacts the bump stop. In this position the "A" frame may be an expanded, free-standing, or self-supporting and the sleeve is properly aligned with the base holes for insertion of the quick release pin. The quick release pin is then pushed through one side of the vertical flange of the base, through the sleeve, and out the opposite side of the vertical base flanges to complete the assembly.

Figure 31A:
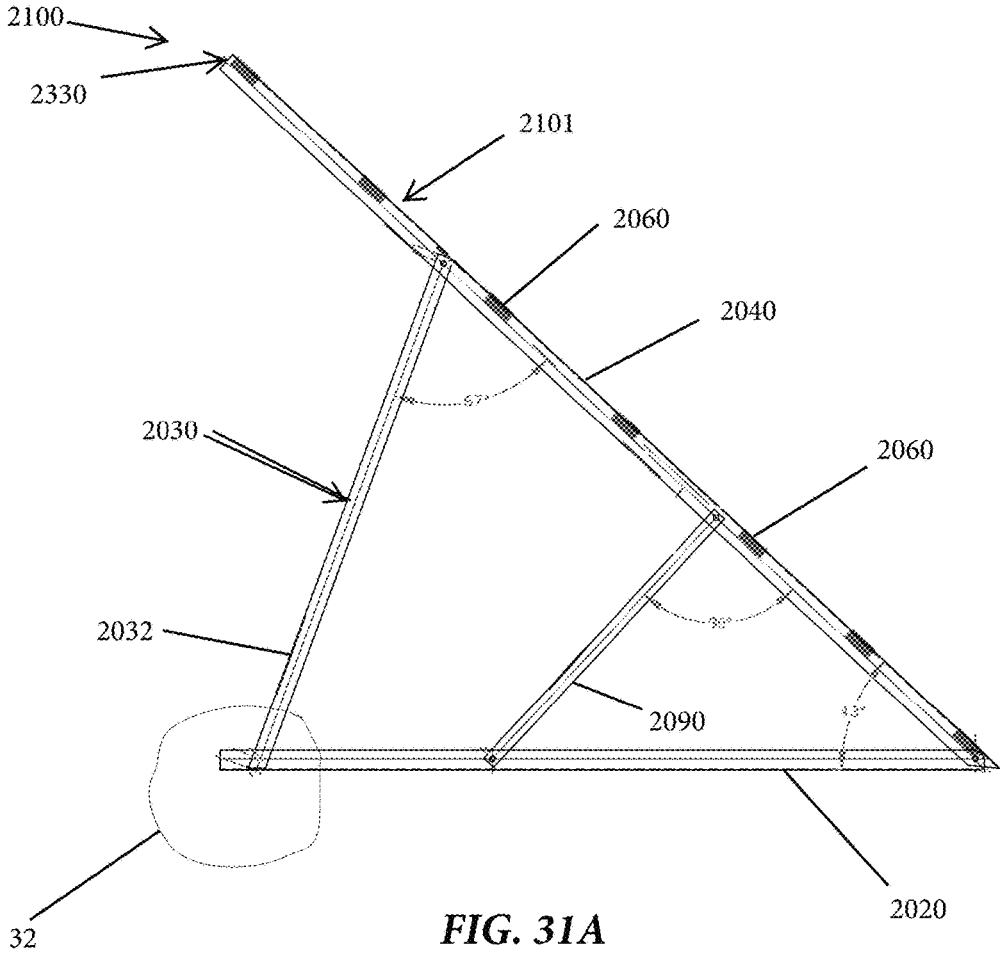
FIG. 31A is a side elevational view of a supporting structure having two braces for a rapid deployment flood protection system for supporting a liner for diverting a liquid, according to an embodiment of the present disclosure.
Figure 31B:
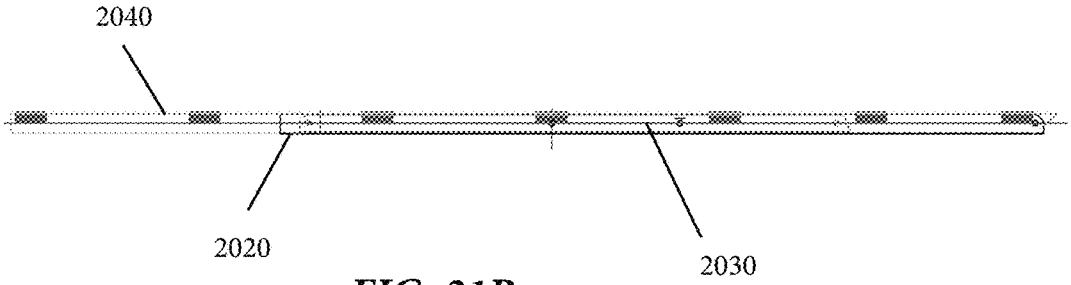
FIG. 31B is a side view of the supporting structure of FIG. 31A disposed in a collapsed configuration, according to an embodiment of the present disclosure.

FIGS. 31A and 31B illustrate a side elevational view support structures 2100 for use with a liner in a rapid deployment flood protection or diversion system, according to an embodiment of the present disclosure, the support structures 2100 of the system may have a deployed or usable configuration generally having an A-frame or elevated configuration, as shown in FIG. 31A, and a collapsed configuration as shown in FIG. 31B. The rapid deployment flood protection or diversion system may be quickly set up as a water barrier. The rapid deployment flood protection or diversion system could be any type of water diversion barrier system, such as a water diversion structure, dam, flood control structure, or other structure for inhibiting or preventing movement of water through the barrier system toward an undesired area or areas.

As described below, support structures 2100 may include a plurality of braces that may be connected to and disposed between a base and a dam face and, a plurality of sleeves may be employed in such braces to receive one or more quick release pins. Similarly, relative to the pivot pin and spacers described above, one or more such sets of pivot pins and spacers may operably connect to the dam face.

Dam faces 2040 may be configured essentially the same dam as faces 40 (FIG. 1), link bars 2060 may be configured essentially the same as link bars 60 (FIG. 1), bases 2020 may be configured essentially the same bases 20 (FIG. 1), and first or long brace 2030 may be configured essentially the same as brace 30 (FIG. 1) with the exceptions as noted below. The dam faces and the link bars may be assembled as described above. As will be appreciated from the description below, the connections between the dam faces, bases, and braces provide a system that permits rapid deployment.

As shown in FIG. 31A, support structure 2100 may include a plurality of frames 2101, which frames 2101 have fixed pivotable connections and quick release connections for use in a rapid deployment flood protection and/or diversion system that may be quickly and readily set up in a usable configuration from a collapsed configuration. The collapsed configuration may be readily and easily stored and transported to a desired site for use. As further described below, frames 2100 may include stops that allow support structure to be temporarily raised and disposed in a secure, expanded usable configuration prior to installing a quick release pin, installing a second brace, and locking the support structures in the usable configuration.

In this illustrated embodiment, support structures 2100 may include a plurality of spaced-apart frames 2101 along with a plurality of linking bars 2060. The components of the plurality of frames 1100 may be assembled with connectors. The connectors may include pins or quick release connectors.

The rapid deployment system may be configured (e.g., shaped and dimensioned) to any shape and to various heights. The rapid deployment system may include a series of interconnected support structures or frame units 2100 spaced at intervals erected on a prepared surface (e.g., a concrete pad) or an irregular surface (e.g., a ground surface) to form a container skeleton or support structure for supporting a liner. For example, dam face 2040 may have a length of about 105 inches, or other suitable length.

As shown in FIG. 31A, one of support structures 2100 may include a frame 2101 having first or long brace 2030, a second or short brace 2090, and a dam face 2040 facing a wet side portion of the barrier system, which may hold a liner (for example, a liner 10 as shown in FIG. 23) and prevent liquid such as water or to inhibit movement of the water in an undesired direction. A base 2020 may connect to long brace 2030, to short brace 2090, and to dam face 2040.

A plurality of instances of dam face 2040 of support structures 2100 may extend upwardly at an angle (e.g., about 43 degrees relative to a longitudinal axis of base 2020) to support the system and any contents of liquid. The dam faces may be supported (e.g., in horizontal and vertical directions) by a plurality of braces (e.g., multiple instances of braces 2030 and 2090). The braces, bases, and dam faces of support structures 2100 may be formed of wood, metal or plastic members fastened to each other and configured to carry the weight of a liquid (e.g., water from a flood) of the diversion system to control a flood, divert water, or otherwise inhibit a flow of water in a particular direction past such frame units. Such braces, bases, and dam faces could also be monolithically formed (e.g., by molding, casting, etc.). For example, the braces, bases, and dam faces may be formed of cold-formed steel members which would meet or exceed AISI S100-12, North American Specification for the Design of Cold-Formed Steel Structural Members.

Dam faces 2040 may be configured essentially the same as dam faces 40 (FIG. 1), link bars 2060 may be configured essentially the same as link bar 60 (FIG. 1), bases 2020 may be configured essentially the same base 20 (FIG. 1), and long brace 2030 and short brace 2090 may be configured essentially the same as braces 30 (FIG. 1) with the exceptions as described below. The dam faces and the link bars may be assembled as described above. As will be appreciated from the description below, the connection between the dam face, base, and braces define a system that may permit rapid deployment.

Figure 32:
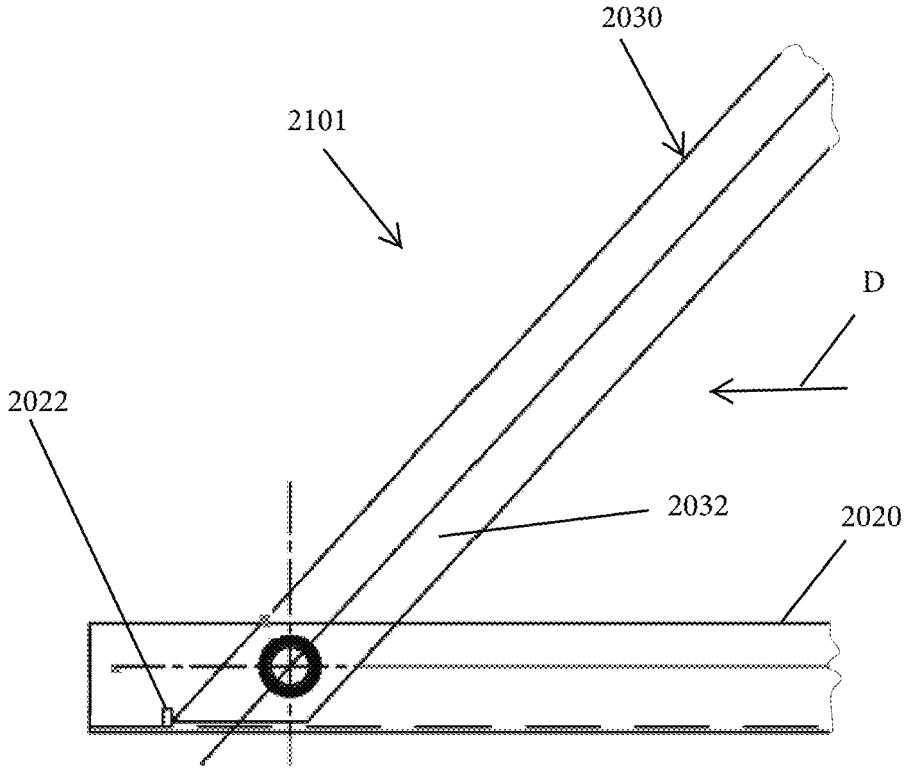
FIG. 32 is an enlarged view of Detail 32 shown in FIG. 31A, according to an embodiment of the present disclosure.

As shown in FIGS. 31A and 32, base 2020 may include a bump stop 2022, according to an embodiment of the present disclosure. Bump stop 2022 may be an upwardly extending projection or portion on base 2020 that may be located on the upper inside surface of base 2020 such that when erecting the supporting structure, a lower end 2032 of long brace 2030, opposite the dam face, may be slid on first base 2020 in the direction of arrow D until lower end 2032 of long brace 2030 contacts bump stop 2022. At such location, bump stop 2022 may hold long brace 2030 and dam face 2040 erect, and a pin such as a quick release pin may be employed for connecting long brace 2030 to base 2020 as described in greater detail below.

In some embodiments, bump stop 2022 may be a ⅛ inch×⅜ inch×1½ inch long steel flat bar with the ⅛ inch edge welded to the upper inside surface of base 2020, perpendicular to base 2020 vertical flanges and centered between base 2020 vertical flanges. As noted above, the purpose of the bump stop is to assist in the field in erecting the system.

Figure 33A:
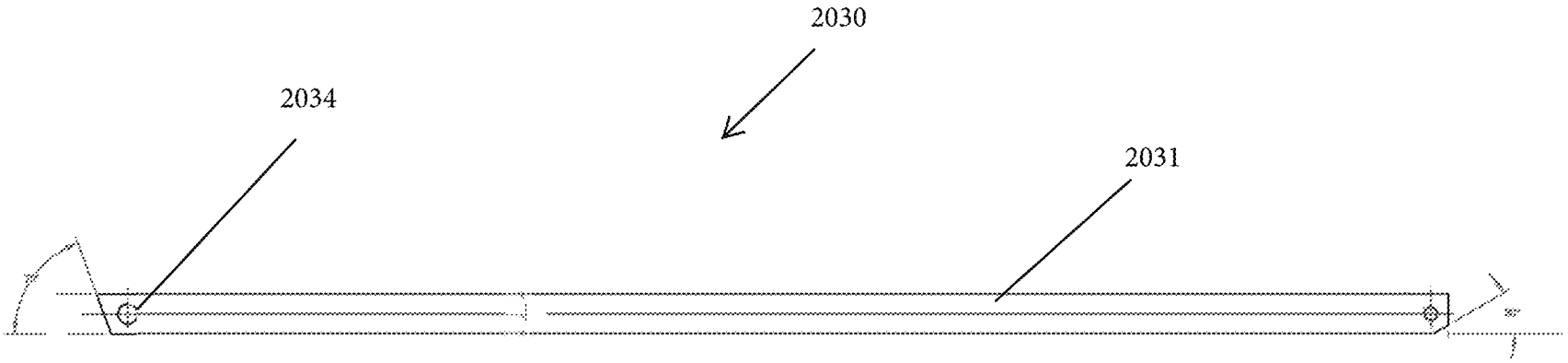
FIG. 33A is an enlarged side elevation view of the first or long brace of FIG. 31A, according to an embodiment of the present disclosure.
Figure 33B:
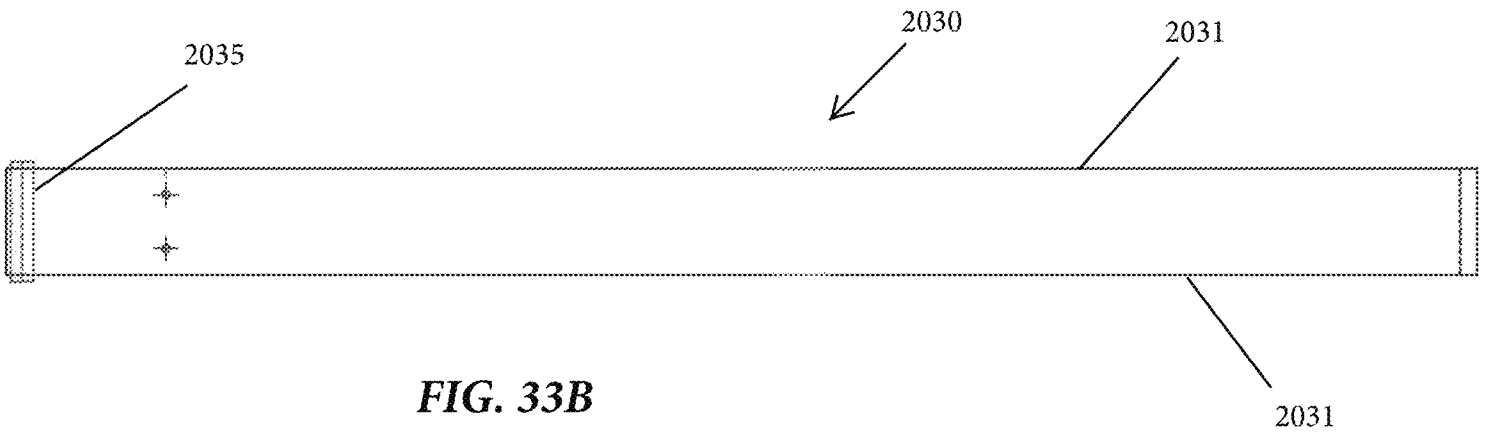
FIG. 33B is a top view of the first or long brace of FIG. 33A, according to an embodiment of the present disclosure.
Figure 34:
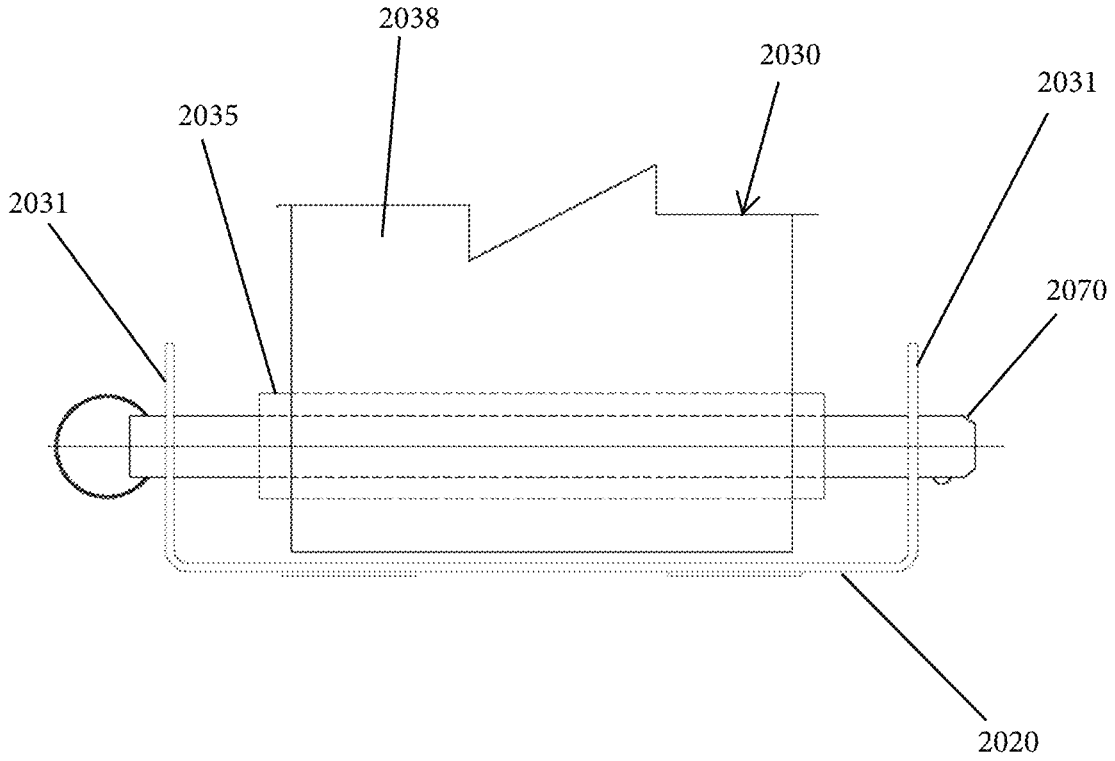
FIG. 34 is an enlarged cross-sectional view of the connection of the first or long brace to the base of FIG. 31A, according to an embodiment of the present disclosure.

As shown in FIGS. 33A and 33B, first or long brace 2030 may include a first hollow sleeve 2035 having a passageway therein that may extend between holes 2034 (one of which is shown in FIG. 33A) in flanges 2031 for, as shown in FIG. 34, receiving a first quick release pin 2070 at a first end or heal end 2038 of long brace 2030. Sleeve 2035 may be welded to opposite sides of long brace 2030 and may receive first quick release pin 2070. For example, the first sleeve may aid insertion of the first quick release pin as it is in alignment to guide the first quick release pin insertion through the vertical flanges of base 2020. Further, first sleeve 2035 may distribute a load from long brace 2030 more uniformly across the first quick release pin relative to an example without such a sleeve where a load would be concentrated on the upwardly extending portions of base 2020 at the location of the holes therethrough receiving a pin.

In some embodiments, sleeve 2035 may be a Drawn Over Mandrel (DOM) steel pipe. Sleeve 2035 may be 4½ inches long and welded into heel end 2038 of long brace 2030 with a ¼ inch protruding past each side or flange of long brace 2030. Sleeve 2035 may have two purposes. First, the sleeve may aid in the assembly of the "A" frame supporting structures. Once the "A" frame supporting structures is opened and heal 2038 of long brace 2030 is placed against bump stop 2022 (FIG. 32), sleeve 2035 is in alignment to guide quick release pin 2070 insertion through the vertical flanges of base 2020. Second, sleeve 2035 may structurally distribute the load from long brace 2030 more uniformly across quick release pin 2035 assuring true pin double shear conditions and minimizing the potential of point load bending of the quick release pin.

Figure 35:
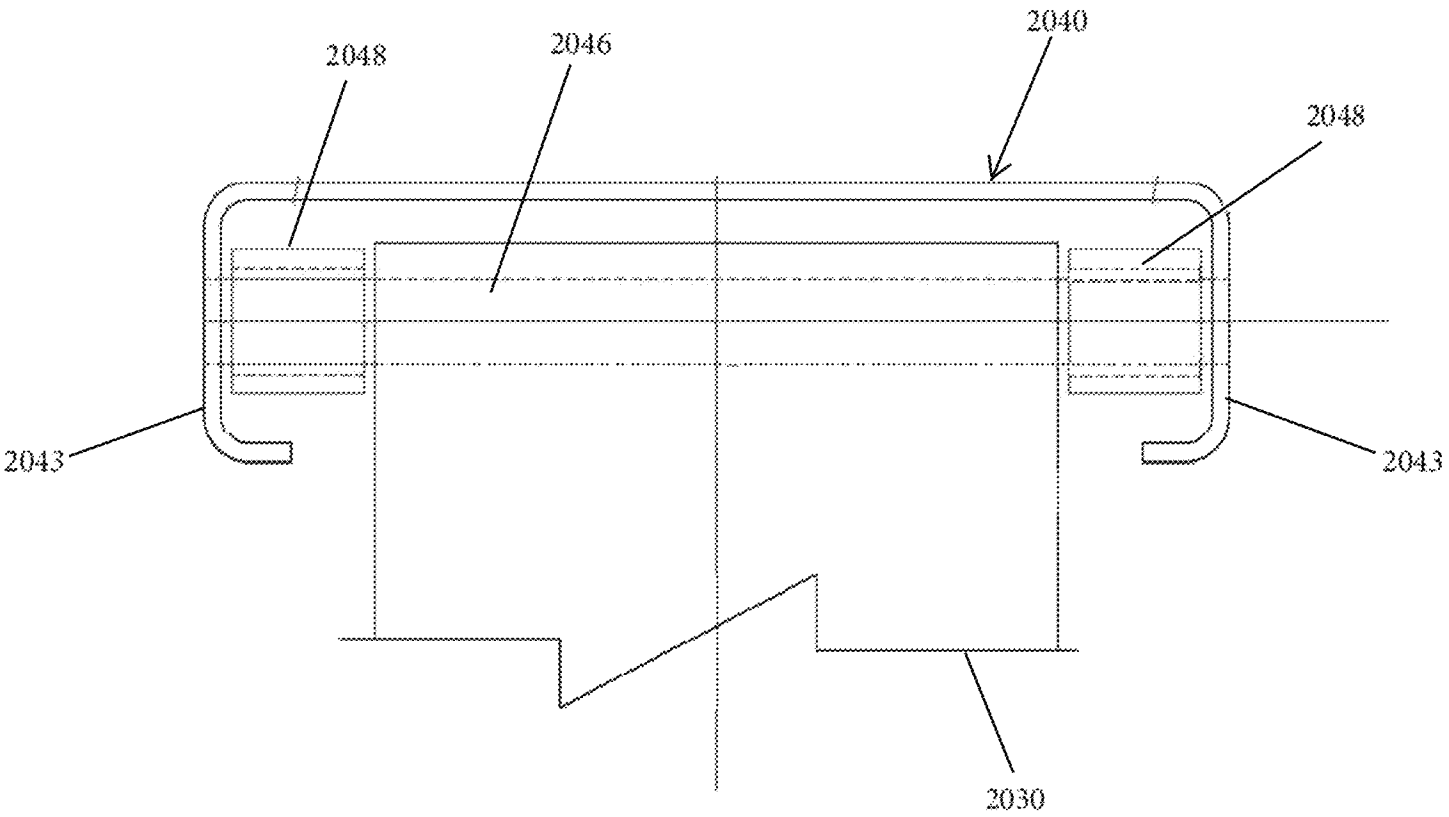
FIG. 35 is an enlarged cross-sectional view of the connection of the first or long brace to the dam face of FIG. 31A, according to an embodiment of the present disclosure.

As shown in FIG. 35, dam face 2040 may be pivotally connected to long brace 2030 generally at a distance about a third of the length from the top of dam face 2040 via a fixed pivot connection, according to an embodiment to the present disclosure. In this illustrated embodiment, the pivot connection may include a pin 2046 and spacers 2048 located thereon between long brace 2030 and inside surfaces of the dam face 2040 to maintain long brace 2030 in a central position relative to a width of the dam face 2040. Pin 2046 may be connected (e.g., welded) to outside surfaces of vertical sides (e.g., sides 2043) of dam face 2040 and received in one of openings 2039 (FIG. 33A) of long brace 2030 to connect dam face 2040 to brace 2030. The pivot pin may initially be assembled with the dam face by threading the pin through an opening in a side of the dam face, an opening in a first spacer, an opening in the brace, openings in a second spacer, and an opening in a second side of the dam face followed by welding of the pin to outside surfaces of the two sides of the dam face.

In some embodiments, pin 2046 may be a ½ inch diameter ASTM A36 steel rod welded to the outside of the two vertical flanges of the dam face. The welded pivot pin eliminates the potential of the liner snagging on a protruding bolt head and nut during operation and causing damage to the liner. The welded pivot pin also provides a uniform width to the "A" frame assembly for ease of stacking during storage, removal from storage during transport, and at site during installation. The spacers may aid or assure that the brace stays or is maintained centered in the dam face during installation and operation. Maintaining a centered position assures more predictable engineering design and analysis result and a more uniform loading of the forces through the brace to the base.

Figure 36:
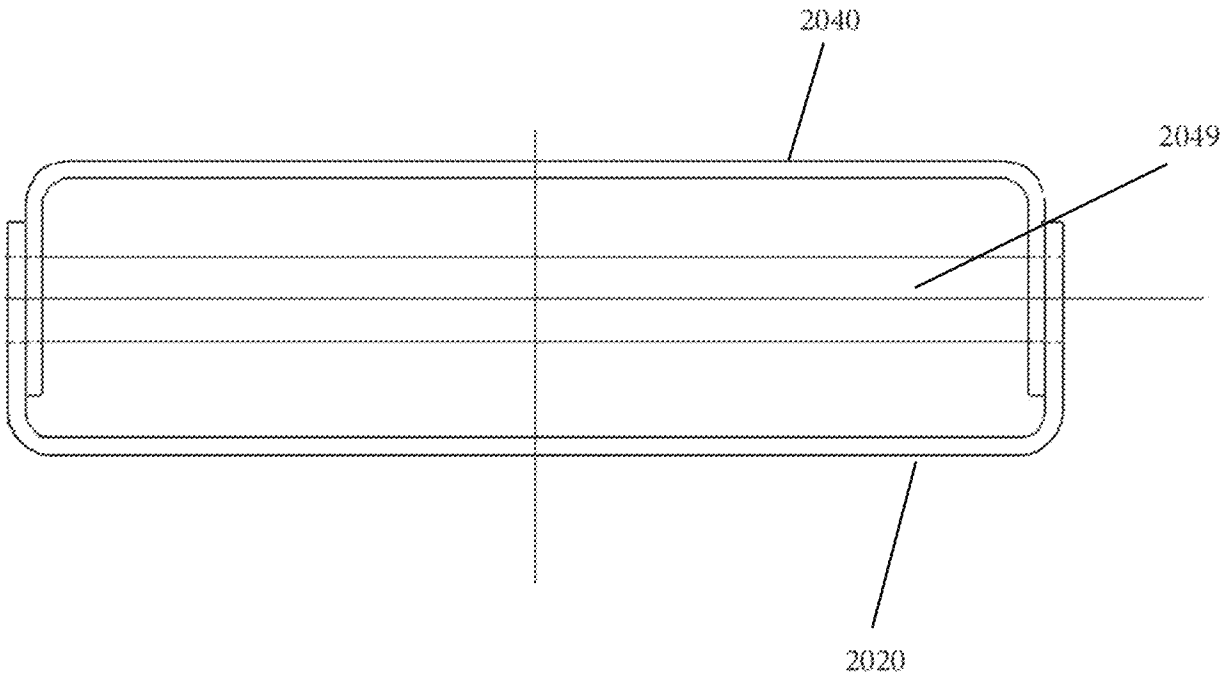
FIG. 36 is an enlarged cross-sectional view of the connection of the dam face to the base of the frame of FIG. 31A, according to an embodiment of the present disclosure.

As shown in FIG. 36, the toe end of dam face 2040 may be fixedly pivotally connected to base 2020 via a pin 2049, according to an embodiment of the present disclosure. Pin 2049 may extend between holes in the flanges of dam face 2040 and holes in the flanges of base 2020 and be welded to opposite flanges of base 2020.

In some embodiments, pin 2049 may be a ½ inch diameter ASTM A36 steel rod welded to the outside of the two vertical flanges of the base. The welded pivot pin may eliminate the potential of the liner snagging on the welded pivot pin compared to a protruding bolt head and nut during operation and causing damage to the liner. The welded pivot pin also provides a uniform width to the "A" frame assembly for ease of stacking during storage and removal from storage during transport and at site when erected.

Figures 37A, 37B:
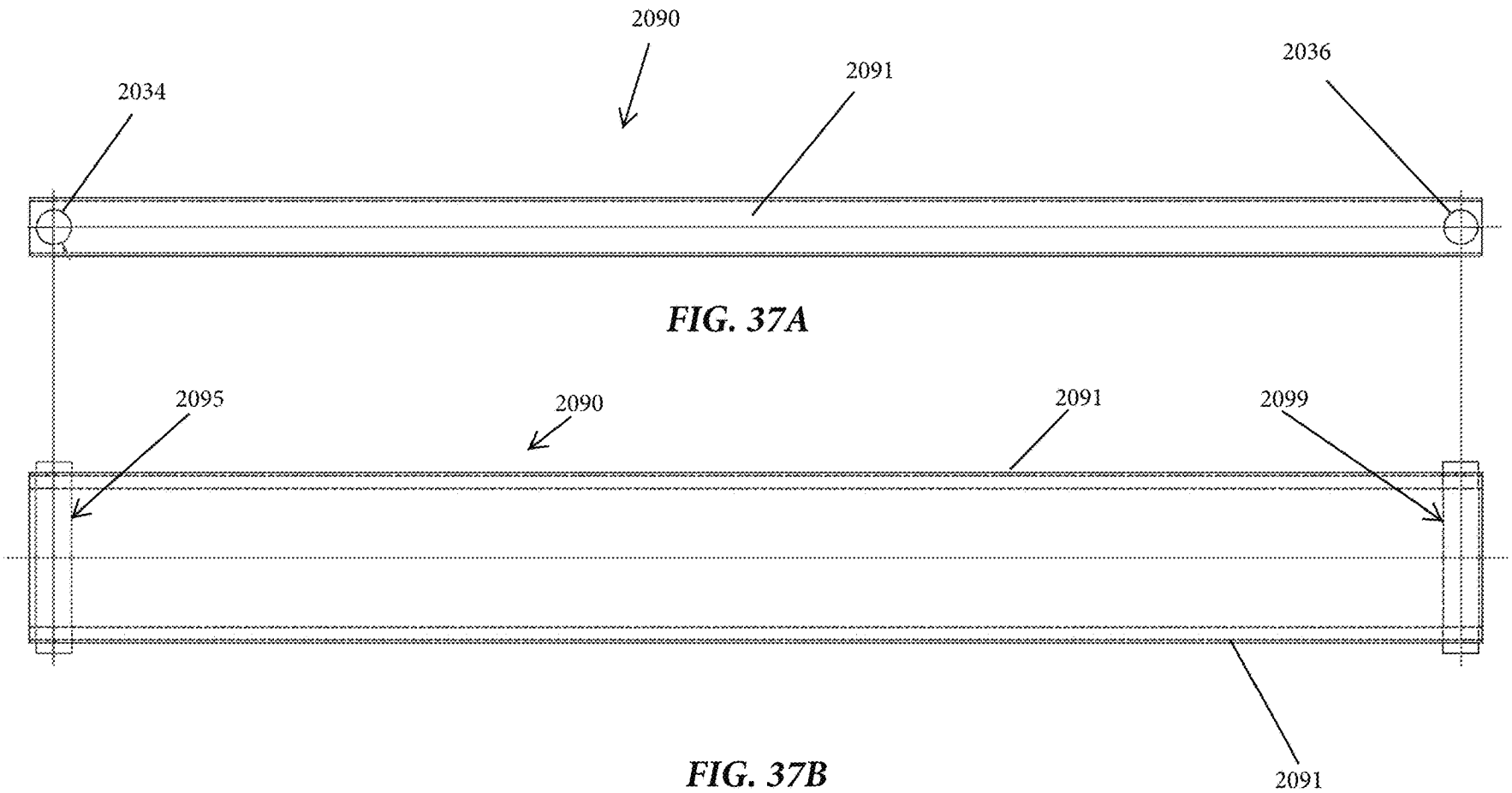
FIG. 37A is an enlarged side elevation view of the short brace of FIG. 31A, according to an embodiment of the present disclosure.
FIG. 37B is a top view of the short brace of FIG. 37A, according to an embodiment of the present disclosure.
Figure 38:
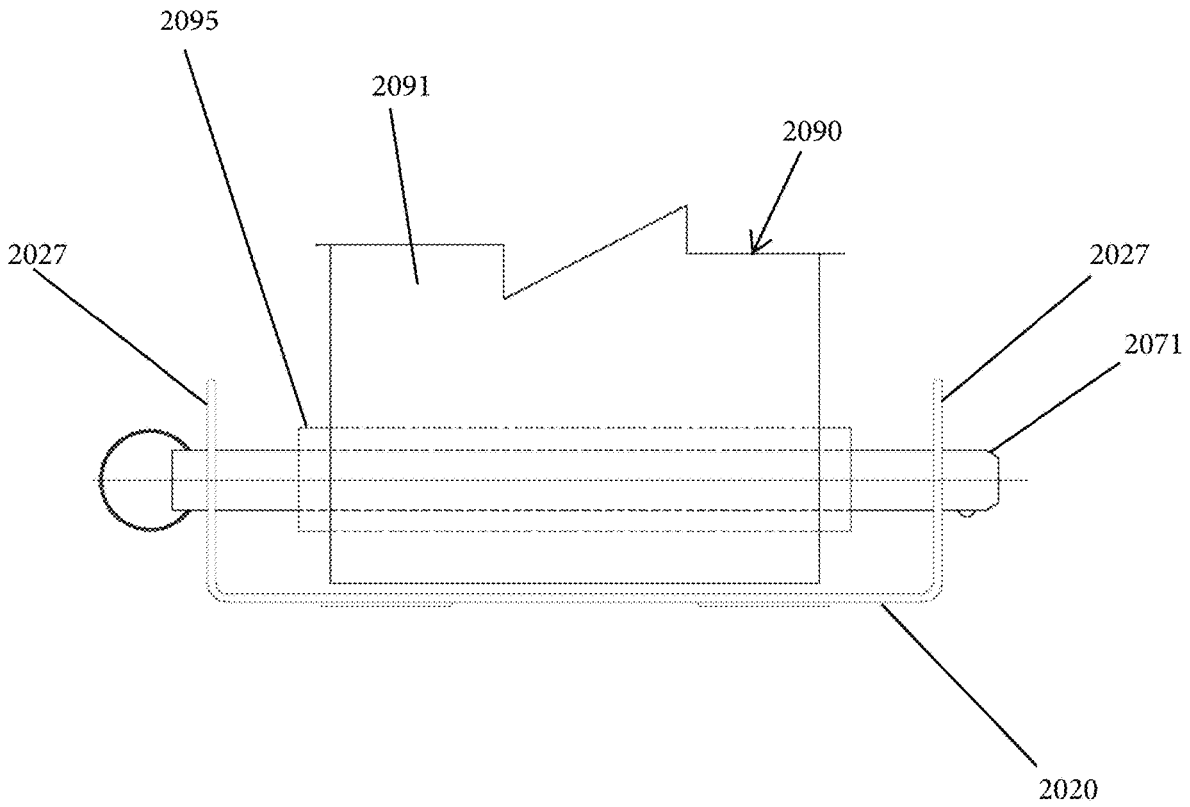
FIG. 38 is an enlarged cross-sectional view of the connection of the short brace to the base of the frame of FIG. 31A, according to an embodiment of the present disclosure.

FIGS. 37A and 37B illustrate second or short brace 2090, according to an embodiment of the present disclosure. In this illustrated embodiment, short brace 2090 may include a first sleeve 2095 and a second sleeve 2099. For example, short brace 2090 may include first sleeve 2095 that extends between holes 2034 (one of which is shown in FIG. 37A) in flanges 2091 for, as shown in FIG. 38, receiving a second quick release pin 2071 at a first end of short brace 2090 for connecting short brace 2090 to base 2020. Short brace 2090 may include second sleeve 2099 that may extend between holes 2036 (one of which is shown in FIG. 37A) in flanges 2091 for, as shown in FIG. 39, receiving a third quick release pin 2073 at a second end of short brace 2090 for connecting short brace 2090 to dam face 2040.

With reference to FIG. 38, first sleeve 2095 may be welded to opposite sides 2091 of short brace 2090 and may receive second quick release pin 2071. For example, first sleeve 2095 may aid insertion of second quick release pin 2071 as it is in alignment to guide the second quick release pin insertion through the vertical flanges 2091 of base 2090. Further, first sleeve 2095 may distribute a load from short brace 2090 more uniformly across the second release pin relative to an example without such a sleeve where a load would be concentrated on the upwardly extending portions or flanges 2027 of base 2020 at the location of the holes therethrough receiving a pin.

Figure 39:
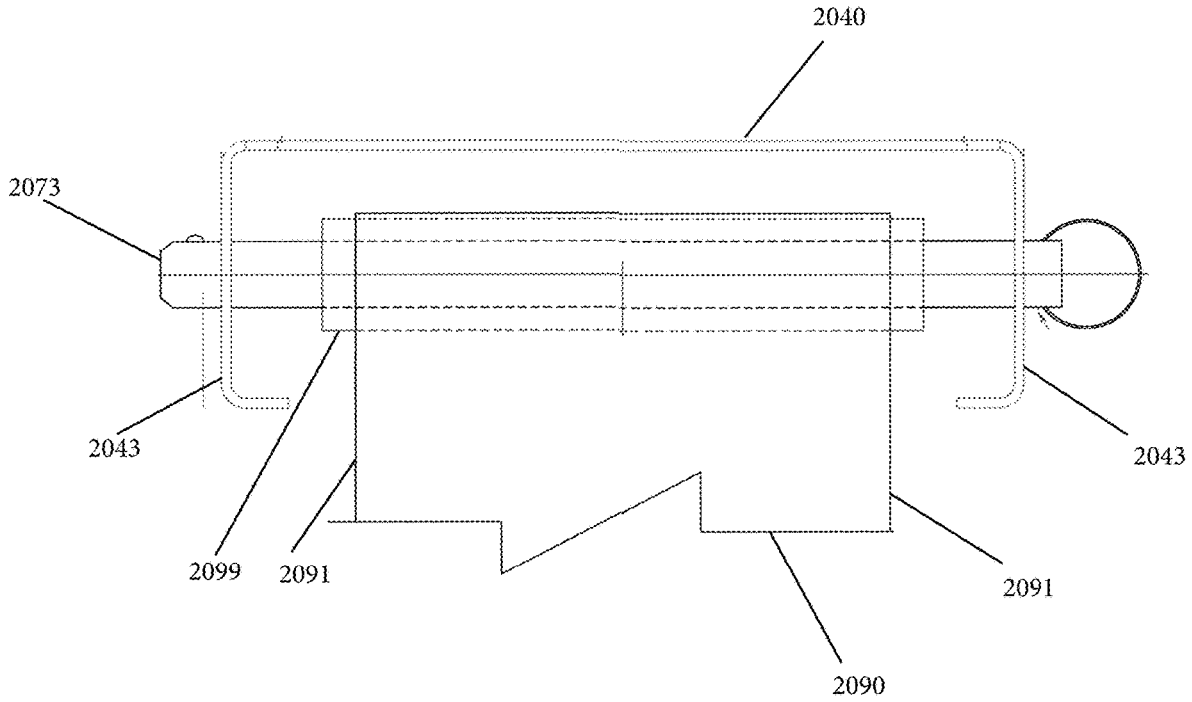
FIG. 39 is an enlarged cross-sectional view of the connection of the short brace to the dam face of FIG. 31A, according to an embodiment of the present disclosure.

As shown in FIG. 39, second sleeve 2099 may be welded to opposite sides 2091 of short brace 2090 and may receive a third quick release pin 2073. For example, second sleeve 2099 may aid insertion of third quick release pin 2073 as it is in alignment to guide the third quick release pin insertion through the vertical flanges 2091 of short brace 2090. Further, second sleeve 2099 may distribute a load from short brace 2090 more uniformly across the third quick release pin relative to an example without such a sleeve where a load would be concentrated on extending portions or flanges 2043 of dam face 2040 at the location of the holes therethrough receiving a pin.

With reference to FIGS. 38 and 39, in some embodiments, sleeves 2095 and 2099 may be a Drawn Over Mandrel (DOM) steel pipe. Sleeves 2095 and 2099 may be 4½ inches long and welded into opposite ends of second brace 2090 with a ¼ inch protruding past each side or flange of short brace 2090. Once the "A" frame supporting structures is opened, short brace 290 may be readily and easily positioned with first sleeve 2095 in alignment to guide the second quick release pin 2071 insertion through the vertical flanges of base 2020. Short brace 2090 may be readily and easily positioned with second sleeve 2099 in alignment to guide the third quick release pin 2073 insertion through the vertical flanges of dam face 2040. As noted above, the sleeves may structurally distribute the load from the second brace more uniformly across the second and third quick release pins assuring true pin double shear conditions and minimizing the potential of point load bending of the quick release pins.

Figure 40:
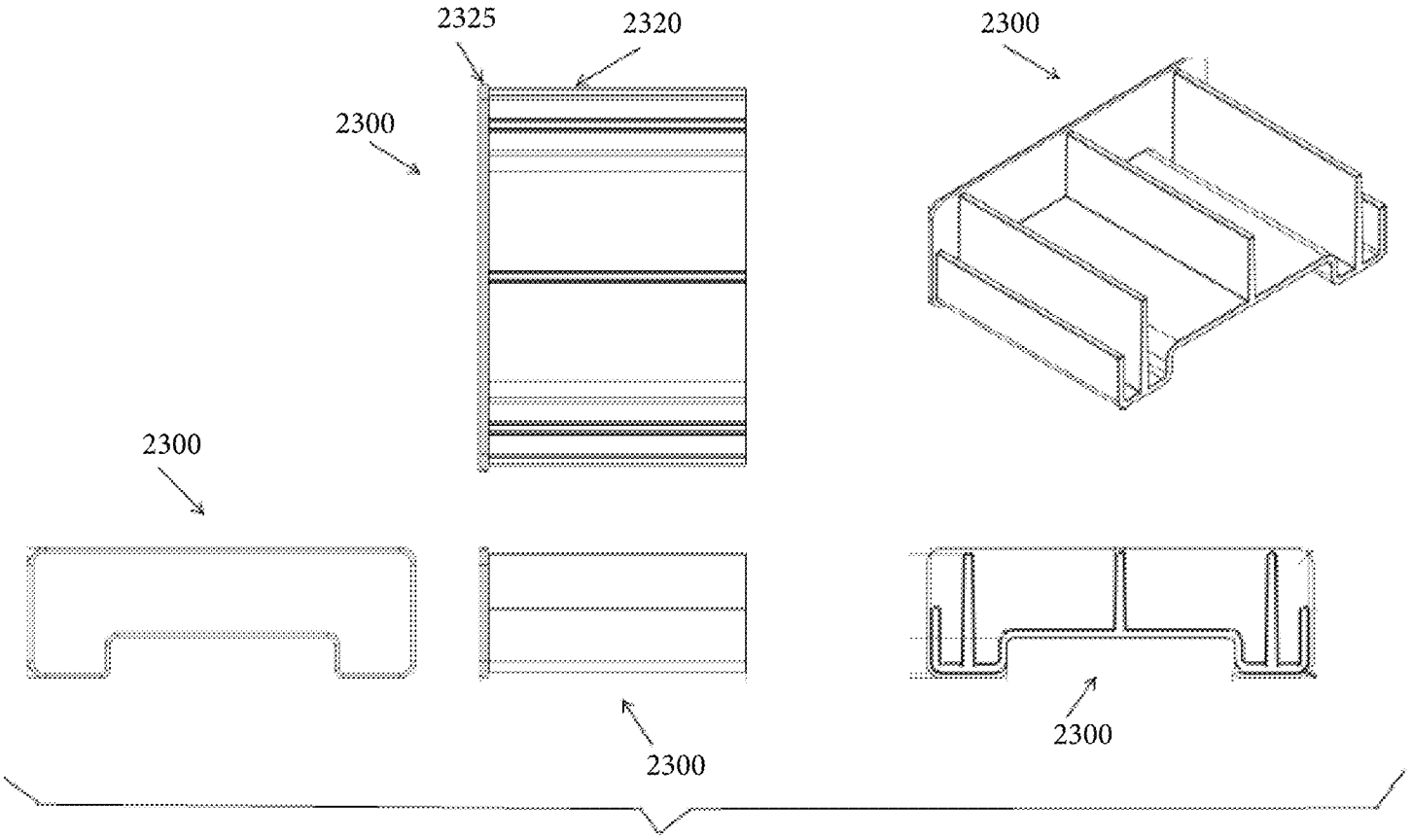
FIG. 40 are front, top, bottom, and side view of a plastic wedge of the support structure of FIG. 31A according to an embodiment of the present disclosure.

FIG. 40 illustrates a wedge 2300, according to an embodiment of the present disclosure. A liner may be connected to support structures 2100 via wedges 2300 and liner clips. Wedge 2300 may be configured (e.g., shaped and dimensioned) to be received in a wedge cavity 2330, e.g., in a top end dam face 2400 (FIG. 31A), in frames 2101 of support structures 2100. Wedge 2300 may include a central stem portion 2320 and a cap or lid 2325, which cap or lid may be located outside the cavity in the dam face. Wedges 2300 may be generally hollow molded plastic wedges, which provides uniformity to the wedge dimensions through the molding process. In addition, the plastic wedges may eliminate the potential for dry splintering and limiting expansion/contraction compared to wedges fabricated from wood due to water adsorption and drying. The wedge and liner clips may be connectable to secure the liner as described above.

With reference again to FIG. 31A, during installation of the flood protection or diversion system employing supporting structure 2100, initially supporting structure 2100 is disposed in a collapsed configuration (as shown in FIG. 31B) with dam face 2040 folded into base 2020 and with the first or long brace 2030 folded up inside dam face 2040. During construction or deployment of the flood protection or diversion system, the collapsed supporting structure is laid on the surface with the dam face 2040 on top and base 2020 (with the cleats) disposed in a downward position or orientation. Dam face 2040 is lifted and rotated around the toe pin until the brace is about 90 degrees to the dam base. The dam brace is then rotated around the pivot pin while the dam face is lowered until the brace heel contacts the bump stop. In this position the "A" frame is self-supporting and the sleeve is properly aligned with the base holes for insertion of the first quick release pin. The first quick release pin is then pushed through one side of the vertical flange of the base, through the sleeve, and out the opposite side of the vertical base flanges to complete an initial assembly. Thereafter, short brace 2090 is installed. For example, the sleeve of the first upper end of short brace 2090 is properly aligned with the dam face holes for insertion of the second quick release pin, and then, the sleeve of the second lower end of short brace 2090 is properly aligned with the base holes for insertion of the third quick release pin.

In the various embodiments, the dam faces may be a C-shaped dam faces, the braces may be C-shaped dam faces, and/or the bases may be C-shaped bases.

In the various embodiments, the quick release pin may be a quick release pin having a spring loaded ball in the tip of the pin to hold the pin in place. In other embodiments, the quick release pin may include a locking pawl operable to lock and unlock using a key or a push button. In some embodiments, quick disconnect pins may be employed. For example, the quick disconnect pins may include a pin have a small opening in the tip of the pin for receiving a cotter pin, hair pin, rue clip, ring clips, or other suitable device for inhibiting removal of the quick disconnect pin. It will be appreciated that other quick release pins or connectors may be suitably employed.

With reference to FIGS. 23 and 31A, the support structures 1100 and 2100 may include additional features found in support structure 100 (FIG. 1) disclosed above. For example, support structures 1100 and 2100 may include rods and braces as described above with reference to support structure 100 (FIG. 1).

Figure 41:
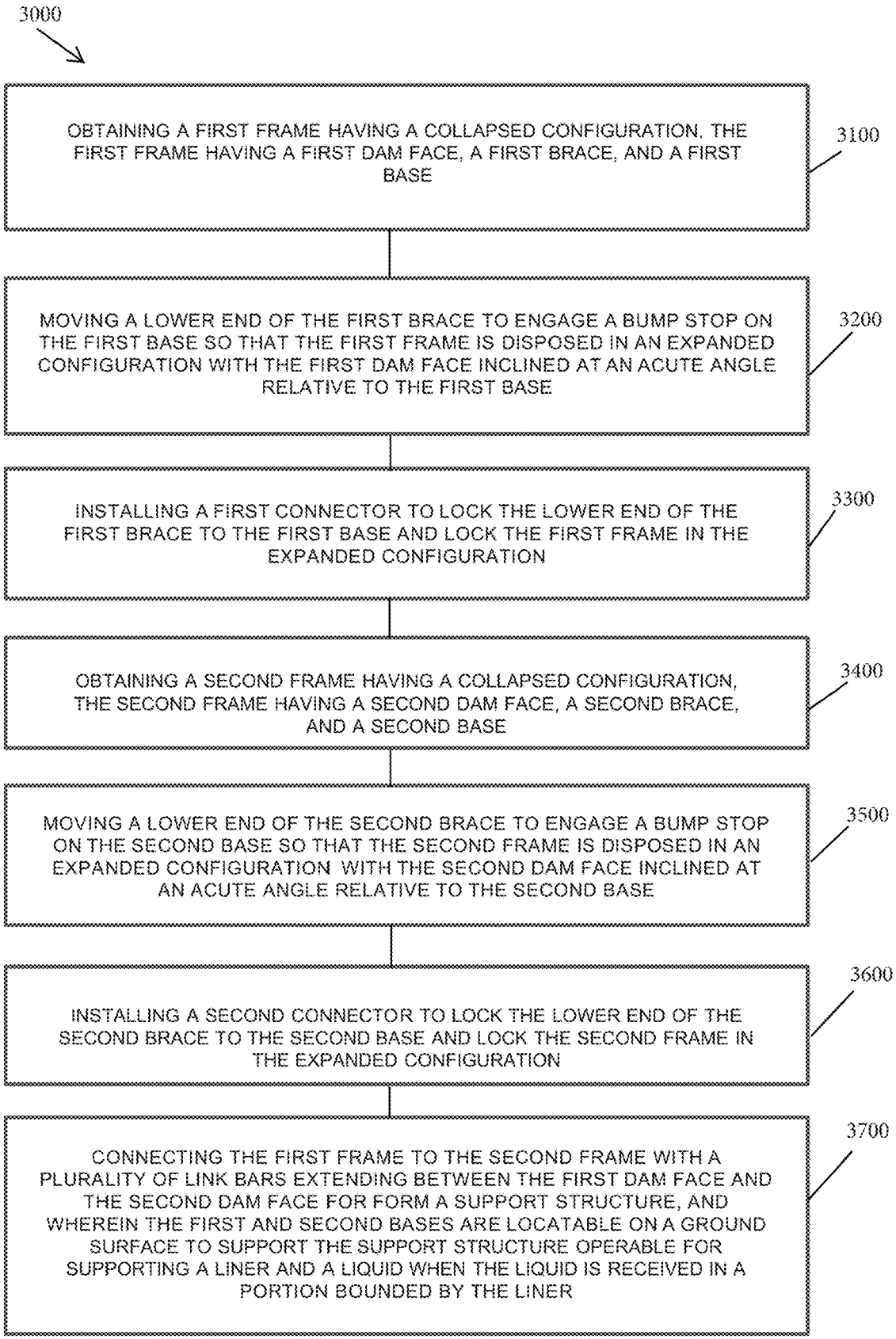
FIG. 41 is a flowchart of a process for diverting liquids, according to an embodiment of the present disclosure.

FIG. 41 illustrates a method 3000 for diverting liquids, according to an embodiment of the present disclosure. In this illustrated embodiment, method 3000 includes at 3100 obtaining a first frame having a collapsed configuration, the first frame comprising a first dam face, a first brace, and a first base, at 3200 moving a lower end of the first brace to engage a bump stop on the first base so that the first frame is disposed in an expanded configuration with the first dam face inclined at an acute angle relative to the first base, at 3300 installing a first connector to lock the lower end of the first brace to the first base and lock the first frame in the expanded configuration, at 3400 obtaining a second frame having a collapsed configuration, the second frame comprising a second dam face, a second brace, and a second base, at 3500 moving a lower end of the second brace to engage a bump stop on the second base so that the second frame is disposed in an expanded configuration with the second dam face inclined at an acute angle relative to the second base, at 3600 installing a second connector to lock the lower end of the first brace to the first base and lock the second frame in the expanded configuration, and at 3700 connecting the first frame to the second frame with a plurality of link bars extending between the first dam face and the second dam face for form a support structure, and wherein the first and second bases are locatable on a ground surface to support the support structure operable for supporting the liner and a liquid when a liquid is received in a portion bounded by the liner.

As may be recognized by those of ordinary skill in the art based on the teachings herein, numerous changes and modifications may be made to the above-described and other embodiments of the present disclosure without departing from the scope of the disclosure. In addition, the devices and apparatus may include more or fewer components or features than the embodiments as described and illustrated herein. Further, the above-described embodiments and/or aspects thereof may be used in combination with each other. Accordingly, this detailed description of the currently-preferred embodiments is to be taken as illustrative, as opposed to limiting the disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), and "contain" (and any form contain, such as "contains" and "containing") are open-ended linking verbs. As a result, a method or device that "comprises", "has", "includes" or "contains" one or more steps or elements possesses those one or more steps or elements but is not limited to possessing only those one or more steps or elements. Likewise, a step of a method or an element of a device that "comprises", "has", "includes" or "contains" one or more features possesses those one or more features but is not limited to possessing only those one or more features. Furthermore, a device or structure that is configured in a certain way is configured in at least that way but may also be configured in ways that are not listed.

For the purposes of promoting an understanding of the principles of the disclosure, reference is made above to embodiments of the disclosure and specific language describing the same. It will nevertheless be understood that no limitation of the scope of the disclosure is thereby intended, and any alterations and further modifications in the described embodiments, and any further applications of the principles of the disclosure as illustrated therein as would normally occur to one skilled in the art to which the disclosure relates are contemplated and protected.

The invention claimed is:

1. A support structure for use with a liner in a deployment flood protection and fluid diversion system, the support structure comprising:

a plurality of spaced-apart frames, each of the plurality of spaced-apart frames comprising:

a dam face having an upper end and a lower end;

a base having a first end and second end, the first end of the base comprising a bump stop, the second end pivotally connected to the lower end of the dam face;

a brace having an upper end and a lower end, the upper end of the brace pivotally connected to the dam face;

the frame having a collapsed configuration with the brace and the base aligned with the dam face;

the frame having an expanded configuration where the brace extends between the base and dam face with the lower end of the brace is engageable with the bump stop and to align openings in the first end of the base and the lower end of the brace so that the dam face is inclined at an acute angle relative to the base;

a removable connector insertable through the aligned openings for connecting the ower end of the brace to the first end of the base when disposed in the expanded configuration; and a plurality of horizontally spaced-apart link bars operably connecting and extending between the dam faces of the plurality of spaced-apart frames;

the bases of the plurality of spaced-apart frames configured to be located on a ground surface to support the support structure; and the support structure operable for supporting the liner and a liquid when a liquid is received in a portion bounded by the liner.

2. The support structure of claim 1 wherein:

the base comprises a C-shaped base; and the hump stop comprises a raised portion extending from an inside surface of the C-shaped base.

3. The support structure of claim 1 wherein:

the removable connector comprises a quick release pin.

4. The support structure of claim 1 wherein:

the brace comprises a C-shaped brace and a sleeve extending between legs of the lower end of the C-shaped brace; and further comprising:

the removable connector extendable through the base and the sleeve.

5. The support structure of claim 4 wherein:

the sleeve extends outwardly from the legs of the C-shaped brace.

6. The support structure of claim 4 wherein:

the removable connector comprises a quick release pin.

7. The support structure of claim 1 further comprising:

a connector for pivotably connecting the upper end of the brace to the dam face;

a first spacer disposed around the connector and disposed between the brace and the dam face; and a second spacer disposed around the connector and disposed between the brace and the dam face.

8. The support structure of claim 7 wherein:

the dam face comprises a C-shaped dam face; and the connector comprises a pin welded to and extending between legs of the C-shaped dam face.

9. The support structure of claim 1 further comprising:

a connector for pivotably connecting the second end of the base to the lower end of the dam face; and wherein:

the base comprises a C-shaped base; and the connector comprises a pin welded to and extending between legs of the C-shaped base.

10. The support structure of claim 9 wherein:

the dam face comprises a C-shaped dam face; and outside surfaces of the legs of the C-shaped dam face disposed adjacent to inside surfaces of the C-shaped base.

11. The support structure of claim 1 wherein each of the plurality of spaced-apart frames comprises:

a second brace having an upper end and a lower end, the upper end of the brace operably connected to the dam face, and the lower end of the brace operably connected to the base.

12. The support structure of claim 11 further comprising:

a quick release pin for connecting the upper end of the brace to the dam face; and a quick release pin for connecting the lower end of the brace to the base.

13. The support structure of claim 11 wherein each of the plurality of spaced-apart frames comprises:

the brace comprising a C-shaped brace and a sleeve extending between legs of the lower end of the C-shaped brace; and the removable connector extendable through the base and the sleeve.

14. The support structure of claim 13 wherein:

the sleeve extends outwardly from the legs of the C-shaped brace.

15. The support structure of claim 1 further comprising the liner.

16. A method for use in diverting a liquid comprising:

providing the support structure of claim 1 in the collapsed configuration;

positioning the support structure in the expanded configuration;

locking the support structure in the expended configuration with the removable connector being a quick release pin; and locating the liner against the dam faces of the support structure.

17. A support structure for use with a liner in a deployment flood protection and fluid diversion system, the support structure comprising:

a plurality of spaced-apart frames, each of the plurality of spaced-apart frames comprising:

a dam face having an upper end and a lower end;

a base having a first end and second end, the second end pivotally connected to the lower end of the dam face;

a C-shaped brace comprising an upper end pivotally connected to the dam face, and a lower end of the brace having a sleeve extending between legs of the lower end of the C-shaped brace, and the sleeve extending outwardly from the legs of the C-shaped brace;

a removable connector extendable through the base and the sleeve;

a fixed connector for pivotably connecting the upper end of the brace to the dam face;

a first spacer disposed around the connector and disposed between the brace and the dam face;

a second spacer disposed around the connector and disposed between the brace and the dam face;

the frame having a first collapsed configuration with the brace and the base aligned with the dam face; and the frame having a second configuration where the brace extends between the base and dam face so that the dam face is inclined at an acute angle relative to the base; and a plurality of horizontally spaced-apart link bars operably connecting and extending between the dam faces of the plurality of spaced-apart frames;

the bases of the plurality of spaced-apart frames configured to be located on a ground surface to support the support structure; and the support structure operable for supporting the liner and a liquid when a liquid is received in a portion bounded by the liner.

18. The support structure of claim 17 wherein:

the removable connector comprises a quick release pin.

19. The support structure of claim 17 wherein:

the dam face comprises a C-shaped dam face;

the base comprises a C-shaped base; and outside surfaces of the legs of the C-shaped dam face are disposed adjacent to inside surfaces of the C-shaped base.

20. The support structure of claim 19 further comprising:

a pin welded to and extending between legs of the lower end of the C-shaped dam face.

21. The support structure of claim 17 further comprising the liner.

22. A method for use in diverting a liquid comprising:

providing the support structure of claim 17; and locating the liner against the dam faces of the support structure.

23. A method comprising:

obtaining a first frame having a collapsed configuration, the first frame comprising a first dam face, a first brace, and a first base;

moving a lower end of the first brace to engage a bump stop on the first base and to align openings in the first base and the lower end of the first brace so that the first frame is disposed in an expanded configuration with the first dam face inclined at an acute angle relative to the first base;

installing a first connector through the aligned openings for connecting the lower end of the first brace to the first base when disposed in the expanded configuration to lock the lower end of the first brace to the first base and lock the first frame in the expanded configuration;

obtaining a second frame having a collapsed configuration, the second frame comprising a second dam face, a second brace, and a second base;

moving a lower end of the second brace to engage a bump stop on the second base and to align openings in the second base and the lower end of the second brace so that the second frame is disposed in an expanded configuration with the second dam face inclined at an acute angle relative to the second base;

installing a second connector through the aligned openings for connecting the lower end of the second brace to the second base when disposed in the expanded configuration to lock the lower end of the second brace to the second base and lock the second frame in the expanded configuration;

connecting the first frame to the second frame with a plurality of link bars extending between the first dam face and the second dam face for form a support structure; and wherein the first and second bases are locatable on a ground surface to support the support structure operable for supporting the liner and a liquid when a liquid is received in a portion bounded by the liner.

24. The method of claim 23 wherein:

the first connector comprises a quick release pin; and the second connector comprises a quick release pin.

25. The method of claim 23 wherein:

the installing the first connector and the second connector prior to connecting the first frame to the second frame with the plurality of link bars.

26. The method of claim 23 further comprising:

a connector for pivotably connecting the upper end of the brace to the dam face;

a first spacer disposed around the connector and disposed between the brace and the dam face; and a second spacer disposed around the connector and disposed between the brace and the dam face.

27. The method of claim 26 wherein:

the dam face comprises a C-shaped dam face; and the connector comprises a pin welded to and extending between legs of the C-shaped dam face.

28. A support structure for use with a liner in a deployment flood protection and fluid diversion system, the support structure comprising:

a plurality of spaced-apart frames, each of the plurality of spaced-apart frames comprising:

a dam face having an upper end and a lower end;

a base having a first end and second end, the first end of the base comprising a bump stop, the second end pivotally connected to the lower end of the dam face;

a brace having an upper end and a lower end, the upper end of the brace pivotally connected to the dam face;

the frame having a collapsed configuration with the brace and the base aligned with the dam face; and the frame having an expanded configuration where the brace extends between the base and dam face with the lower end of the brace is engageable with the bump stop so that the dam face is inclined at an acute angle relative to the base; and a plurality of horizontally spaced-apart link bars operably connecting and extending between the dam faces of the plurality of spaced-apart frames;

the bases of the plurality of spaced-apart frames configured to be located on a ground surface to support the support structure;

the support structure operable for supporting the liner and a liquid when a liquid is received in a portion bounded by the liner;

wherein:

the brace comprises a C-shaped brace and a sleeve extending between legs of the lower end of the C-shaped brace; and further comprising a removable connector extendable through the base and the sleeve; and the sleeve extends outwardly from the legs of the C-shaped brace.

29. A method comprising:

obtaining a first frame having a collapsed configuration, the first frame comprising a first dam face, a first brace; and a first base, the first brace comprises a first C-shaped brace and a first sleeve extending between legs of a lower end of the first C-shaped brace and the sleeve extending outwardly from the legs of the first C-shaped brace;

moving a lower end of the first brace to engage a bump stop on the first base so that the first frame is disposed in an expanded configuration with the first dam face inclined at an acute angle relative to the first base;

installing a first connector extendable through the first C-shaped base and the first sleeve to lock the lower end of the first brace to the first base and lock the first frame in the expanded configuration;

obtaining a second frame having a collapsed configuration, the second frame comprising a second dam face, a second brace, and a second base, the second brace comprises a second C-shaped brace and a second sleeve extending between legs of a lower end of the second C-shaped brace and second sleeve extending outwardly from the legs of the second C-shaped brace;

moving a lower end of the second brace to engage a bump stop on the second base so that the second frame is disposed in an expanded configuration with the second dam face inclined at an acute angle relative to the second base;

installing a second connector extendable through the second C-shaped base and the second sleeve to lock the lower end of the second brace to the second base and lock the second frame in the expanded configuration;

connecting the first frame to the second frame with a plurality of link bars extending between the first dam face and the second dam face for form a support structure; and wherein the first and second bases are locatable on a ground surface to support the support structure operable for supporting the liner and a liquid when a liquid is received in a portion bounded by the liner.

* * * * *